US011189235B2

(12) United States Patent
Ueno

(10) Patent No.: US 11,189,235 B2
(45) Date of Patent: Nov. 30, 2021

(54) DISPLAY DEVICE AND METHOD FOR DRIVING SAME

(71) Applicant: SHARP KABUSHIKI KAISHA, Osaka (JP)

(72) Inventor: Tetsuya Ueno, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/982,000

(22) PCT Filed: Mar. 29, 2018

(86) PCT No.: PCT/JP2018/013138
§ 371 (c)(1),
(2) Date: Sep. 17, 2020

(87) PCT Pub. No.: WO2019/186865
PCT Pub. Date: Oct. 3, 2019

(65) Prior Publication Data

US 2021/0134232 A1 May 6, 2021

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0876* (2013.01)

(58) Field of Classification Search
CPC ..... G09G 2320/043; G09G 2320/0233
See application file for complete search history.

(56) References Cited

U.S. PATENT DOCUMENTS 10,004,124 B1 * 6/2018 Ko ..... G09G 3/3233
2012/0001896 A1 1/2012 Han et al.
2013/0201172 A1 * 8/2013 Jeong ..... G09G 3/3258 345/212
2016/0124491 A1 * 5/2016 An ..... G09G 3/3233 713/323
2016/0322443 A1 * 11/2016 Her ..... G09G 3/3233
2017/0316739 A1 * 11/2017 Oh ..... G09G 3/3266

FOREIGN PATENT DOCUMENTS

JP 2011-164133 A 8/2011

* cited by examiner

*Primary Examiner* — Sepehr Azari
(74) *Attorney, Agent, or Firm* — ScienBiziP, P.C.

(57) ABSTRACT

The present disclosure discloses a current-driven display device that uses an internal compensation method and can display a good-quality image with no bright dots that are not included in intended display content. In a pixel circuit of an organic EL display device, a voltage of a gate terminal of a drive transistor is initialized before the voltage of a data signal line is written to a holding capacitor via the drive transistor in a diode-connected state. A drain terminal of a first initialization transistor is connected to an anode electrode of the organic EL element in another pixel circuit adjacent to the drain terminal in a scanning signal line extension direction. In a reset period, a path for applying an initialization voltage to the gate terminal is formed by a second initialization transistor of the other pixel circuit, an initialization connecting line, and the first initialization transistor of the pixel circuit.

13 Claims, 10 Drawing Sheets

--RELATED ART--

--RELATED ART--

--RELATED ART--

DISPLAY DEVICE AND METHOD FOR DRIVING SAME

TECHNICAL FIELD

The disclosure relates to a display device, and more particularly to a current-driven display device including a display element driven by a current, such as an organic electro luminescence (EL) display device, and a method for driving the display device.

BACKGROUND ART

The last few years have seen the implementation of organic EL display devices provided with a pixel circuit including organic EL elements (also referred to as organic light-emitting diodes (OLEDs)). The pixel circuit in such an organic EL display device includes a drive transistor, a write control transistor, and a holding capacitor in addition to the organic EL elements. A thin film transistor is used for the drive transistor and the write control transistor. The holding capacitor is connected to a gate terminal that serves as a control terminal of the drive transistor. A voltage corresponding to an image signal representing an image to be displayed (more specifically, a voltage indicating the gradation values of pixels to be formed by the pixel circuit, hereinafter referred to as "data voltage") is applied to the holding capacitor from the drive circuit via a data signal line. The organic EL element is a self-luminous display element that emits light with luminance according to an electric current flowing through the organic EL element. The drive transistor is connected to the organic EL element in series and controls the electric current passing through the organic EL element according to a voltage held by the holding capacitor.

Variation and fluctuation occur in characteristics of the organic EL element and the drive transistor. Thus, variation and fluctuation in characteristics of these elements need to be compensated in order to perform higher picture quality display in the organic EL display device. For the organic EL display device, a method for compensating a characteristic of an element inside a pixel circuit and a method for compensating a characteristic of an element outside a pixel circuit are known. One known pixel circuit corresponding to the former method is a pixel circuit configured to charge the holding capacitor with the data voltage via the drive transistor in a diode-connected state after initializing voltage at the gate terminal of the drive transistor, that is, the voltage held in the holding capacitor. In such a pixel circuit, variation and fluctuation of the threshold voltage in the drive transistor are compensated for within the pixel circuit (hereinafter, the compensation of variation and fluctuation of threshold voltage is referred to as "threshold compensation").

As described above, an item associated with an organic EL display device that employs a method of threshold compensation in a pixel circuit (hereinafter referred to as an "internal compensation method") is described in, for example, PTL 1. In other words, PTL 1 discloses several pixel circuits configured to charge the holding capacitor with the data voltage via the drive transistor in a diode-connected state after initializing, to a predetermined level, voltage of the gate terminal of the drive transistor, i.e., the voltage held in the holding capacitor. In these pixel circuits, the voltage of the gate terminal connected to the holding capacitor is initialized by applying an initialization power supply VINT via a path including a plurality of transistors (see, for example, FIGS. 4, 8(A), and 10).

CITATION LIST

Patent Literature

PTL 1: US Patent Application No. 2012/0001896
PTL 2: JP 2011-164133 A

SUMMARY

Technical Problem

In an organic EL display device employing an internal compensation method, when the pixel circuit is configured as described above to write a data voltage to the holding capacitor via the drive transistor in a diode-connected state after initializing the voltage of the gate terminal of the drive transistor (corresponding to the holding voltage of the holding capacitor), a bright dot that is not included in the intended display content in the display image (hereinafter referred to as a "bright dot defect") may occur.

Because of this, there is a need to display a good-quality image with no bright dot defect in a current-driven display device such as an organic EL display device employing an internal compensation method.

Solution to Problem

A display device according to several embodiments of the disclosure is a display device including a plurality of data signal lines, a plurality of scanning signal lines intersecting the plurality of data signal lines, and a plurality of pixel circuits arranged in a matrix along the plurality of data signal lines and the plurality of scanning signal lines, the display device including:

an initialization voltage supply line;

a data signal line drive circuit configured to drive the plurality of data signal lines; and a scanning signal line drive circuit configured to selectively drive the plurality of scanning signal lines, each pixel circuit including:

a display element driven by a current;

a holding capacitor configured to hold a voltage used for controlling a drive current of the display element;

a drive transistor configured to control a drive current of the display element according to a voltage held by the holding capacitor; and first and second initialization switching elements, in which, in each pixel circuit, a first terminal of the display element is connected to the initialization voltage supply line via the second initialization switching element, in any two pixel circuits of the plurality of pixel circuits corresponding to any one of the plurality of scanning signal lines and being adjacent to each other in an extension direction of the plurality of scanning signal lines, a control terminal of the drive transistor in a first pixel circuit of the two pixel circuits is connected to the first terminal of the display element in a second pixel circuit of the two pixel circuits via the first initialization switching element in the first pixel circuit, and when the two pixel circuits are to be initialized, the first and second initialization switching elements in the two pixel circuits are controlled to an on state.

A method for driving a display device according to several other embodiments of the disclosure is a method for driving a display device including a plurality of data signal lines, a plurality of scanning signal lines intersecting the plurality of data signal lines, an initialization voltage supply line, and a plurality of pixel circuits arranged in a matrix along the plurality of data signal lines and the plurality of scanning signal lines, the method for driving a display device including:

an initialization step of initializing each pixel circuit, in which each pixel circuit includes:

a display element driven by a current;

a holding capacitor configured to hold a voltage used for controlling a drive current of the display element;

a drive transistor configured to control a drive current of the display element according to a voltage held by the holding capacitor; and first and second initialization switching elements, in each pixel circuit, a first terminal of the display element is connected to the initialization voltage supply line via the second initialization switching element, in any two pixel circuits of the plurality of pixel circuits corresponding to any one of the plurality of scanning signal lines and being adjacent to each other in an extension direction of the plurality of scanning signal lines, a control terminal of the drive transistor in a first pixel circuit of the two pixel circuits is connected to the first terminal of the display element in a second pixel circuit of the two pixel circuits via the first initialization switching element in the first pixel circuit, and in the initialization step, when the first and second pixel circuits are to be initialized, the first and second initialization switching elements are controlled to an on state.

Advantageous Effects of Disclosure

In the several embodiments of the disclosure described above, in any two pixel circuits of the plurality of pixel circuits corresponding to any one of the plurality of scanning signal lines and being adjacent to each other in an extension direction of the plurality of scanning signal lines, the control terminal of the drive transistor in a first pixel circuit of the two pixel circuits is connected to the first terminal of the display element in the second pixel circuit of the two pixel circuits via the first initialization switching element in the one pixel circuit, and the first terminal is connected to the initialization voltage supply line via the second initialization switching element. When any two pixel circuits are to be initialized, the first and second initialization switching elements in the two pixel circuits are controlled to an on state. As a result, the voltage of the initialization voltage supply line is applied to the control terminal of the drive transistor via the second initialization switching element of the second pixel circuit and the first initialization switching element of the first pixel circuit. With such a configuration, the voltage applied to the first initialization switching element in the off state in the light emission period, in which the display element is driven based on the holding voltage of the holding capacitor, is smaller than in the related art. As a result, voltage fluctuation at the control terminal of the drive transistor due to leakage current of the switching element in the off state during the light emission period is suppressed. Thus, according to the several embodiments of the disclosure described above, it is possible to provide a pixel circuit that has a threshold compensation function and in which no bright dot defect (a bright dot not included in the intended display content) occurs due to leakage current without increasing the area of the pixel circuit.

On the other hand, when a path for initializing the voltage of the control terminal of the drive transistor passes through a terminal of the display element as described above, excessive lighting of the display element occurs due to discharged current used for initialization during the initialization period of the terminal (reset period). However, in the several embodiments of the disclosure described above, the control terminal of the drive transistor in the first pixel circuit is connected to the initialization voltage supply line via the first terminal of the display element in the second pixel circuit. Thus, when displaying an image in which light pixels and dark pixels are arranged adjacent to each other in the extension direction (horizontal direction) of the scanning signal line, excess lighting occurs in a direction that improves the contrast of the displayed image, and the contrast of the displayed image caused by the excess light can be suppressed.

BRIEF DESCRIPTION OF DRAWINGS

FIG. 7(A) illustrates a reset operation of the pixel circuit according to the first embodiment, FIG. 7(B) illustrates a data write operation of the pixel circuit, and FIG. 7(C) illustrates a lighting operation of the pixel circuit.

DESCRIPTION OF EMBODIMENTS

In the following, each embodiment will be described with reference to the accompanying drawings. Note that in each of the transistors referred to below, the gate terminal corresponds to a control terminal, one of the drain terminal and the source terminal corresponds to a first conduction terminal, and the other corresponds to a second conduction terminal. All the transistors in each embodiment are described as P-channel transistors, but the disclosure is not limited thereto. Furthermore, the transistor in each embodiment is, for example, a thin film transistor, but the disclosure is not limited thereto. Still further, the term "connection"

used herein means "electrical connection" unless otherwise specified, and without departing from the spirit and scope of the disclosure, the term includes not only a case in which direct connection is meant but also a case in which indirect connection with another element therebetween is meant.

1. Overall Configuration

Figure 1:
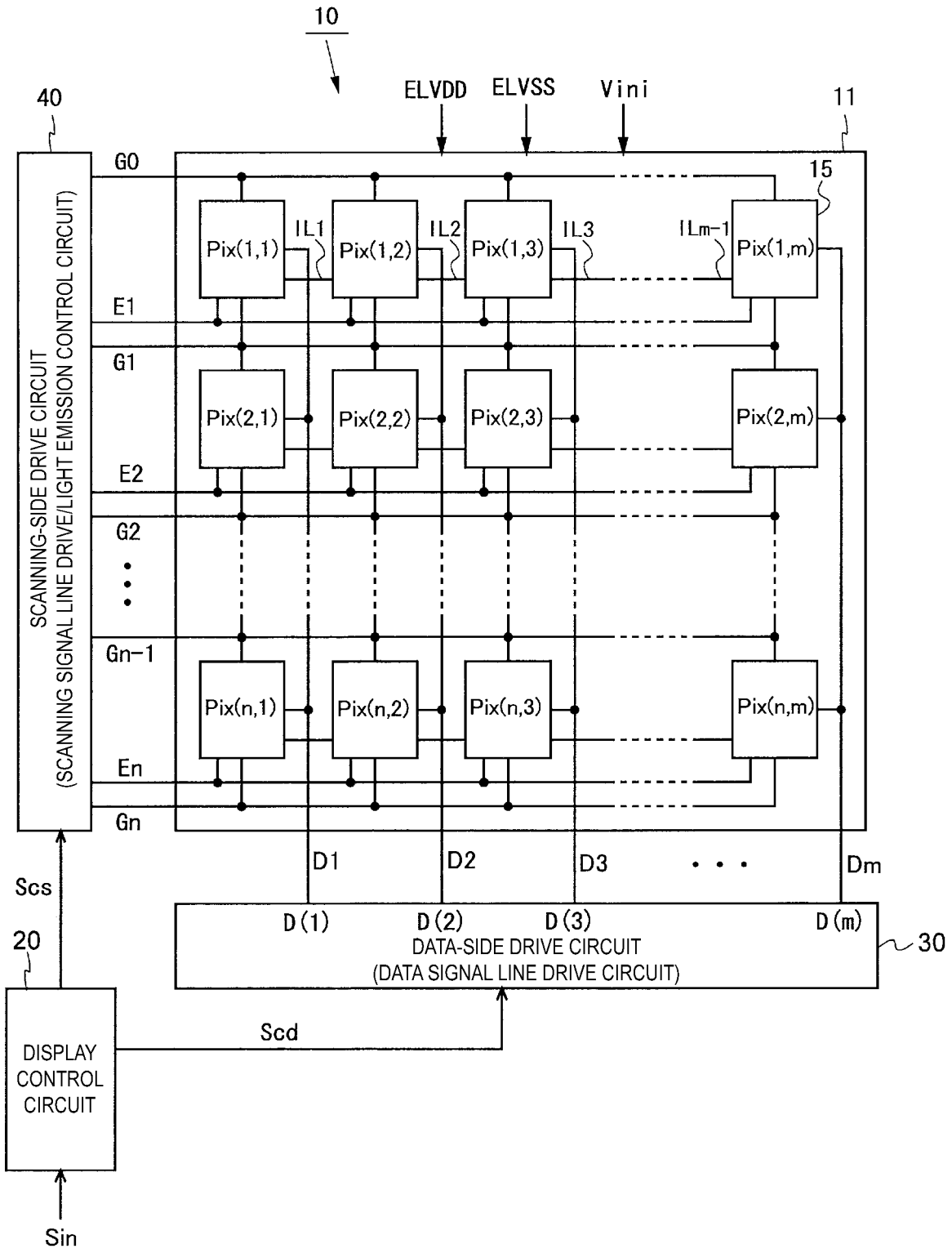
FIG. 1 is a block diagram illustrating an overall configuration of a display device according to a first embodiment.

FIG. 1 is a block diagram illustrating an overall configuration of an organic EL display device 10 according to a first embodiment. The display device 10 is an organic EL display device that performs internal compensation. That is, when pixel data is written to each pixel circuit in the display device 10, a holding capacitor is charged with voltage of a data signal (data voltage) via a drive transistor in a diode-connected state in each pixel circuit to compensate for variations and fluctuations in the threshold voltage of the drive transistor (details described later).

As illustrated in FIG. 1, the display device 10 includes a display portion 11, a display control circuit 20, a data-side drive circuit 30, and a scanning-side drive circuit 40. The data-side drive circuit 30 functions as a data signal line drive circuit (also referred to as a "data driver"). The scanning-side drive circuit 40 functions as a scanning signal line drive circuit (also referred to as a "gate driver") and a light emission control circuit (also referred to as an "emission driver"). The two drive circuits are configured as one scanning-side drive circuit 40 in the configuration illustrated in FIG. 1, but a configuration where the two drive circuits are separated as needed in the scanning-side drive circuit 40, or a configuration where the two drive circuits are disposed separately on different sides of the display portion 11 may be adopted. Additionally, the scanning-side drive circuit may be integrally formed with the display portion 11. The same applies to modification examples to be described later.

The display portion 11 is provided with m (m is an integer of 2 or more) data signal lines D1 to Dm and n+1 (n is an integer of 2 or more) scanning signal lines G0 to Gn that intersect the data signal lines D1 to Dm, and n light emission control lines (also referred to as "emission lines") E1 to En disposed along the n scanning signal lines G1 to Gn, respectively. As illustrated in FIG. 1, the display portion 11 is provided with m×n pixel circuits 15. The m×n pixel circuits 15 are arranged in a matrix along the m data signal lines D1 to Dm and the n scanning signal lines G1 to Gn. Each pixel circuit 15 corresponds to any one of the m data signal lines D1 to Dm and to any one of the n scanning signal lines G1 to Gn (hereinafter, when distinguishing between each pixel circuit 15, a pixel circuit corresponding to an ith scanning signal line Gi and a jth data signal line Dj will also be referred to as an "ith row, jth column pixel circuit", and will be denoted by the reference sign "Pix(i, j)"). The n light emission control lines E1 to En correspond to the n scanning signal lines G1 to Gn, respectively. Accordingly, each pixel circuit 15 also corresponds to any one of the n light emission control lines E1 to En. Note that, among the m×n pixel circuits 15, two pixel circuits 15 adjacent to the extension direction of the scanning signal line Gi are connected to each other by an initialization connecting line ILj (j=1 to m−1). Details of those will be described later.

The display portion 11 is also provided with a power source line (not illustrated) common to each pixel circuit 15. In other words, a power source line (hereinafter, referred to as a "high-level power source line" and designated by the reference sign "ELVDD" similar to the high-level power supply voltage) used for supplying the high-level power supply voltage ELVDD for driving the organic EL element described later, and a power source line (hereinafter, referred to as a "low-level power source line" and designated by the reference sign "ELVSS" similar to the low-level power supply voltage) used for supplying the low-level power supply voltage ELVSS for driving the organic EL element are provided. The display portion 11 also includes an initialization voltage line (not illustrated and denoted by the reference sign "Vini" similar to the initialization voltage) used for supplying an initialization voltage Vini (as a fixed voltage) used in a reset operation for initializing each pixel circuit 15 (details described later). The high-level power supply voltage ELVDD, the low-level power supply voltage ELVSS, and the initialization voltage Vini are supplied from a power source circuit (not illustrated).

The display control circuit 20 receives an input signal Sin including image information representing an image to be display and timing control information for image display from outside of the display device 10 and, based on the input signal Sin, generates a data-side control signal Scd and a scanning-side control signal Scs, and outputs the data-side control signal Scd to the data-side drive circuit (data signal line drive circuit) 30 and outputs the scanning-side control signal Scs to the scanning-side drive circuit (scanning signal line drive/light emission control circuit) 40.

The data-side drive circuit 30 drives the data signal lines D1 to Dm based on the data-side control signal Scd output from the display control circuit 20. More specifically, the data-side drive circuit 30 outputs in parallel m data signals D(1) to D(m) representing an image to be displayed, and applies the data signals D(1) to D(m) to the data signal lines D1 to Dm, respectively, based on the data-side control signal Scd.

The scanning-side drive circuit 40 functions as a scanning signal line drive circuit that drives the scanning signal lines G0 to Gn and a light emission control circuit that drives the light emission control lines E1 to En based on the scanning-side control signal Scs output from the display control circuit 20. More specifically, when functioning as the scanning signal line drive circuit, the scanning-side drive circuit 40 sequentially selects the scanning signal lines G0 to Gm in individual frame periods based on the scanning-side control signal Scs, and applies an active signal (low-level voltage) to a selected scanning signal line Gk and an inactive signal (high-level voltage) to the unselected scanning signal lines. With this, m pixel circuits Pix(k, 1) to Pix(k, m) corresponding to the selected scanning signal line Gk ($1 \leq k \leq n$) are collectively selected. As a result, in the select period of the scanning signal line Gk (hereinafter referred to as a "kth scanning select period"), the voltages of the m data signals D(1) to D(m) applied to the data signal lines D1 to Dm from the data-side drive circuit 30 (hereinafter also referred to as simply "data voltages" when not distinguished from each other) are written as pixel data to the pixel circuits Pix(k, 1) to Pix(k, m), respectively.

When functioning as the light emission control circuit, based on the scanning side control signal Scs, the scanning-side drive circuit 40 applies a light emission control signal (high-level voltage) indicating non-light emission to an ith light emission control line Ei in an i−1th horizontal period and an ith horizontal period, and applies a light emission control signal (low-level voltage) indicating light emission to the ith light emission control line Ei in other periods. Organic EL elements in pixel circuits (hereinafter also referred to as "ith row pixel circuits") Pix(i, 1) to Pix(i, m) corresponding to the ith scanning signal line Gi emit light at luminance corresponding to the data voltages written to the ith row pixel circuits Pix(i, 1) to Pix(i, m), respectively, while the voltage of the light emission control line Ei is at a low level.

2. Configuration and Operation of Pixel Circuit in First Known Example

Prior to describing the configuration and operation of the pixel circuit 15 in the present embodiment, the configuration and operation of a pixel circuit 15*a* in a known organic EL display device (hereinafter referred to as a "first known example") as a pixel circuit for comparison with the pixel circuit 15 will be described with reference to FIGS. 2 and 3. The overall configuration of the first known example is similar to the configuration illustrated in FIG. 1 except for the initialization connecting line ILj (j=1 to m−1).

Figure 2:
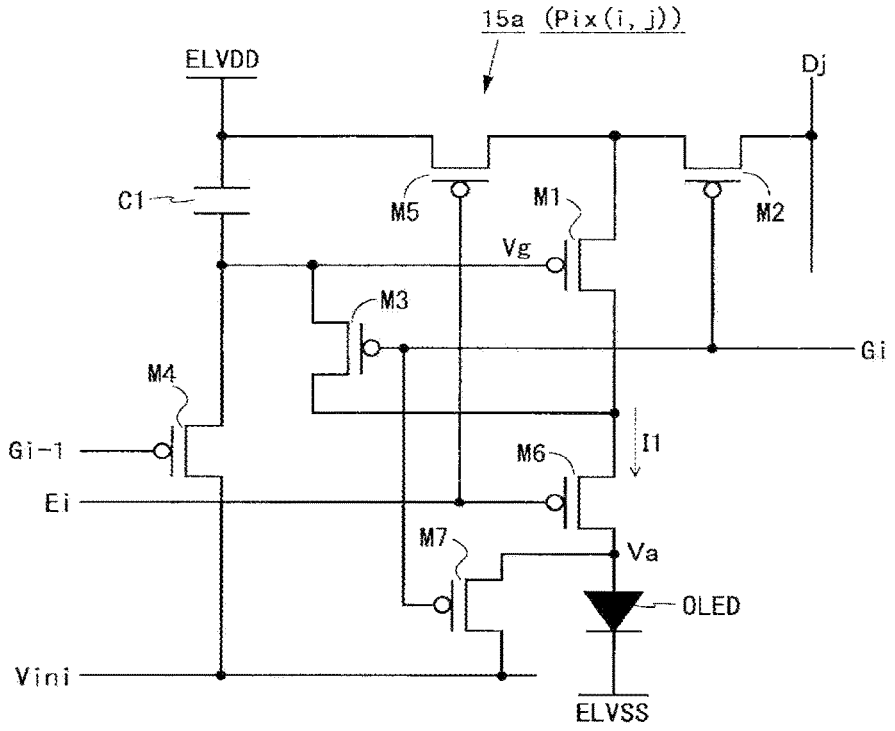
FIG. 2 is a circuit diagram illustrating a configuration of a pixel circuit in a known display device (first known example).

FIG. 2 is a circuit diagram illustrating a configuration of the pixel circuit 15*a* in the first known example, and more specifically, a pixel circuit 15*a* corresponding to the ith scanning signal line Gi and the jth data signal line Dj, i.e., a pixel circuit representing the configuration of the ith row, jth column pixel circuit Pix(i, j) (1≤i≤n, 1≤j≤m). As illustrated in FIG. 2, the pixel circuit 15*a* includes an organic EL element OLED as a display element, a drive transistor M1, a write control transistor M2, a threshold compensation transistor M3, a first initialization transistor M4, a first light emission control transistor M5, a second light emission control transistor M6, a second initialization transistor M7, and a holding capacitor C1. In the pixel circuit 15*a*, the transistors M2 to M7 other than the drive transistor M1 function as switching elements.

In the pixel circuit 15*a*, a scanning signal line corresponding to the pixel circuit 15*a* (hereinafter also referred to as a "corresponding scanning signal line" in the description focusing on the pixel circuit) Gi, a scanning signal line immediately before the corresponding scanning signal line Gi (a scanning signal line immediately before the scanning signal lines G1 to Gn in scanning order, hereinafter also referred to as a "preceding scanning signal line" in the description focusing on the pixel circuit) Gi−1, a light emission control line corresponding to the preceding scanning signal line (hereinafter also referred to as a "corresponding light emission control line" in the description focusing on the pixel circuit) Ei, a data signal line corresponding to the corresponding light emission control line Ei (hereinafter also referred to as a "corresponding data signal line" in the description focusing on the pixel circuit) Dj, the initialization voltage supply line Vini, the high-level power source line ELVDD, and the low-level power source line ELVSS are connected to each other.

As illustrated in FIG. 2, in the pixel circuit 15*a*, a source terminal of the drive transistor M1 is connected to the corresponding data signal line Dj via the write control transistor M2 and to the high-level power source line ELVDD via the first light emission control transistor M5. A drain terminal of the drive transistor M1 is connected to an anode electrode of the organic EL element OLED via the second light emission control transistor M6. The gate terminal of the drive transistor M1 is connected to the high-level power source line ELVDD via the holding capacitor C1, the drain terminal of the drive transistor M1 via the threshold compensation transistor M3, and the initialization voltage supply line Vini via the first initialization transistor M4. The anode electrode of the organic EL element OLED is connected to the initialization voltage supply line Vini via the second initialization transistor M7, and a cathode electrode of the organic EL element OLED is connected to the low-level power source line ELVSS. Gate terminals of the write control transistor M2, the threshold compensation transistor M3, and the second initialization transistor M7 are connected to the corresponding scanning signal line Gi. Gate terminals of the first and second light emission control transistors M5 and M6 are connected to the corresponding light emission control line Ei. A gate terminal of the first initialization transistor M4 is connected to the preceding scanning signal line Gi−1.

The drive transistor M1 operates in a saturation region. A drive current I1 flowing through the organic EL element OLED in the light emission period is given by Equation (1) below. A gain β of the drive transistor M1 included in Equation (1) is given by Equation (2) below.

$$I1 = (\beta/2)(|Vgs| - |Vth|)^2 = (\beta/2)(|Vg - ELVDD| - |Vth|)^2 \quad (1)$$

$$\beta = \mu \times (W/L) \times Cox \quad (2)$$

In Equations (1) and (2), Vth, μ, W, L, and Cox represent the threshold voltage, mobility, gate width, gate length, and gate insulating film capacitance per unit area of the drive transistor M1, respectively.

Figure 3:
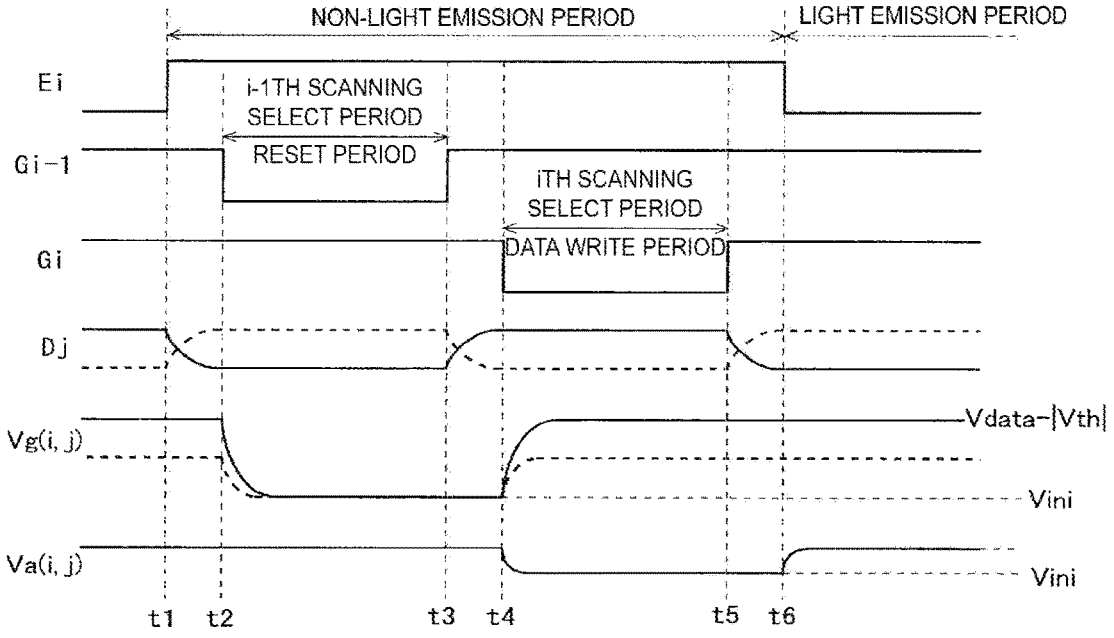
FIG. 3 is a signal waveform diagram for explaining drive of the known display device.

FIG. 3 is a signal waveform diagram for explaining drive of the display device according to the first known example, and illustrates fluctuation in the voltages of the signal lines (corresponding light emission control line Ei, preceding scanning signal line Gi−1, corresponding scanning signal line Gi, and corresponding data signal line Dj) in the initialization operation, the reset operation, and the lighting operation of the pixel circuit 15*a* illustrated in FIG. 2, i.e., the ith row, jth column pixel circuit Pix(i, j), a voltage of the gate terminal of the drive transistor M1 (hereinafter referred to as "gate voltage") Vg, and a voltage of the anode electrode of the organic EL element OLED (hereinafter referred to as "anode voltage") Va. In FIG. 3, the period from the time t1 to the time t6 represents the non-light emission period of the ith row pixel circuits Pix(i, 1) to Pix(i, m). The period from the time t2 to the time t4 is the i−1th horizontal period, and the period from the time t2 to the time t3 is the select period of the i−1th scanning signal line (preceding scanning signal line) Gi−1 (hereinafter referred to as an "i−1th scanning select period"). The i−1th scanning select period corresponds to a reset period of the ith row pixel circuits Pix(i, 1) to Pix (i, m). The period from the time t4 to the time t6 is the ith horizontal period, and the period from the time t4 to the time t5 is the select period of the ith scanning signal line (corresponding scanning signal line) Gi (hereinafter referred to as "ith scanning select period"). The ith scanning select period corresponds to a data write period of the ith row pixel circuits Pix(i, 1) to Pix(i, m).

In the ith row, jth column pixel circuit Pix(i, j), when the voltage of the light emission control line Ei changes from the low level to the high level at the time t1 as illustrated in FIG. 3, the first and second light emission control transistors M5 and M6 change from the on state to the off state, and the organic EL element OLED enters a non-light emission state. During the period from the time t1 to the start time t2 of the i−1th scanning select period, the data-side drive circuit 30 starts to apply the data signal D(j) to the data signal line Dj as the data voltage of the i−1th row, jth column pixel, and, in the pixel circuit Pix(i, j), the write control transistor M2 connected to the data signal line Dj is in an off state.

At the time t2, the voltage of the preceding scanning signal line Gi−1 changes from the high level to the low level, which causes the preceding scanning signal line Gi−1 to enter a select state. Due to this change, the first initialization transistor M4 enters an on state. Thus, the voltage of the gate terminal of the drive transistor M1, i.e., the gate voltage Vg is initialized to the initialization voltage Vini. The initialization voltage Vini is such a voltage that the voltage can keep the drive transistor M1 in an on state during the writing of the data voltage to the pixel circuit Pix(i, j). More specifically, the initialization voltage Vini satisfies the following Equation (3).

$$|Vini-Vdata|>|Vth| \quad (3)$$

where Vdata represents the data voltage (voltage of the corresponding data signal line Dj), and Vth represents the threshold voltage of the drive transistor M1. Further, because the drive transistor M1 in the present embodiment is a P-channel transistor, $$Vini<Vdata \quad (4).$$

By initializing the gate voltage Vg to the initialization voltage Vini in such a way, the data voltage can be reliably written to the pixel circuit Pix(i, j). Note that the initialization of the gate voltage Vg is also the initialization of the holding voltage of the holding capacitor C1.

The period from the time t2 to the time t3 is a reset period in the ith row pixel circuits Pix(i, 1) to Pix(i, m). In the pixel circuit Pix(i, j), the gate voltage Vg is initialized by the first initialization transistor M4 being in the on state in the reset period as described above. FIG. 3 illustrates a change in a gate voltage Vg(i, j) in the pixel circuit Pix(i, j) at this time. Note that the reference sign "Vg(i, j)" is used to differentiate the gate voltage Vg in the pixel circuit Pix(i, j) from the gate voltage Vg in other pixel circuits (the same applies hereinafter).

At the time t3, the voltage of the preceding scanning signal line Gi−1 changes to the high level, which causes the preceding scanning signal line Gi−1 to enter a non-select state. Therefore, the first initialization transistor M4 changes to an off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) at least until the end time t5 of the ith scanning select period.

At the time t4, the voltage of the corresponding scanning signal line Gi changes from the high level to the low level, which causes the corresponding scanning signal line Gi to enter a select state. Because of this, the write control transistor M2 changes to the on state. The threshold compensation transistor M3 also changes to the on state, and hence the drive transistor M1 is in a state in which the gate terminal and the drain terminal of the drive transistor M1 are connected, i.e., in a diode-connected state. As a result, the voltage of the corresponding data signal line Dj, i.e., the voltage of the data signal D(j) is applied to the holding capacitor C1 as the data voltage Vdata via the drive transistor M1 in the diode-connected state. As a result, as illustrated in FIG. 3, the gate voltage Vg(i, j) changes toward the value given by Equation (5) below.

$$Vg(i,j)=Vdata-|Vth| \quad (5)$$

At the time t4, the voltage of the corresponding scanning signal line Gi changes from the high level to the low level, which causes the second initialization transistor M7 to change to the on state. As a result, accumulated charge in the parasitic capacitance of the organic EL element OLED is discharged and the anode voltage Va of the organic EL element is initialized to the initialization voltage Vini (see FIG. 3). Note that the reference sign "Va(i, j)" is used to differentiate the anode voltage Va in the pixel circuit Pix(i, j) from the anode voltage Va in other pixel circuits (the same applies hereinafter).

The period from the time t4 to the time t5 is a data write period in the ith row pixel circuits Pix(i, 1) to Pix(i, m). In the pixel circuit Pix(i, j), a data voltage that has undergone threshold compensation is written to the holding capacitor C1 in the data write period, and the gate voltage Vg(i, j) is the value given by Equation (5) above.

Then, at the time t6, the voltage of the light emission control line Ei changes to a low level. Accordingly, the first and second light emission control transistors M5 and M6 change to the on state. Thus, after the time t6, the current I1 flows from the high-level power source line ELVDD to the low-level power source line ELVSS via the first light emission control transistor M5, the drive transistor M1, the second light emission control transistor M6, and the organic EL element OLED. This current I1 is given by Equation (1) above. Considering that the drive transistor M1 is a P-channel transistor and ELVDD>Vg, the current I1 is given by Equations (1) and (5) above.

$$\begin{aligned} I1 &= (\beta/2)(ELVDD - Vg - |Vth|)^2 \\ &= (\beta/2)(ELVDD - Vdata)^2 \end{aligned} \quad (6)$$

As described above, after the time t6, the organic EL element OLED emits light at a luminance corresponding to the data voltage Vdata, which is the voltage of the corresponding data signal line Dj in an ith scanning select period, regardless of the threshold voltage Vth of the drive transistor M1.

3. Problems in First Known Example

As described above, a display device such as that in the first known example described above, i.e., a display device employing a pixel circuit configured to write a data voltage to a holding capacitor via a drive transistor in a diode-connected state after initializing the gate voltage of the drive transistor has a problem in that a bright dot defect occurs in the display image. The present inventors studied the operation of the pixel circuit 15*a* in the first known example to find the cause of the bright dot defect. Now, the results of this study will be described.

In the pixel circuit 15*a* (Pix(i, j)) in the first known example described above, the voltage of the corresponding data signal line Dj is applied to the holding capacitor C1 as the data voltage Vdata via the drive transistor M1 in the diode-connected state, thereby compensating for variation and fluctuation in the threshold voltage Vth of the drive transistor M1. In a pixel circuit employing such an internal compensation method, initialization of the gate voltage Vg of the drive transistor M1, i.e., initialization of the holding voltage of the holding capacitor C1, needs to be performed before the data write operation. Thus, as illustrated in FIG. 2, in the first known example described above, the gate terminal of the drive transistor M1 is connected to the initialization voltage supply line Vini via the first initialization transistor M4.

When the pixel circuit 15*a* in the first known example is to create a black display, in the data write period, a high voltage near the high-level power supply voltage ELVDD is applied to the gate terminal of the drive transistor M1 as the data voltage Vdata via the drive transistor M1 in the diode-connected state, and in the light emission period, the gate voltage Vg is maintained at the high voltage by the holding capacitor C1. Thus, in the light emission period, a relatively high voltage (e.g., approximately 8 V) is continuously applied between the source and drain of the first initialization transistor M4 in the off state. As a result, leakage current may occur in the first initialization transistor M4, which may cause the gate voltage Vg to drop. If this occurs, an amount of current that does not correspond to the value of the written data voltage flows to the drive transistor M1 and the organic EL element OLED, and this generates a bright dot (bright dot defect) not included in the intended display content. A bright dot defect is particularly likely to occur when the off resistance of the first initialization transistor M4 decreases or the threshold voltage (absolute value) of the drive transistor M1 decreases due to manufacturing variation.

Using a transistor with a multi-gate structure, a transistor having a long channel length, or two transistors connected to each other in series as the first initialization transistor M4 has also been considered to minimize the occurrence of a bright dot defect. However, using such transistors increases the size of the first initialization transistor M4 and makes it difficult to achieve compact a pixel circuit.

Figure 4:
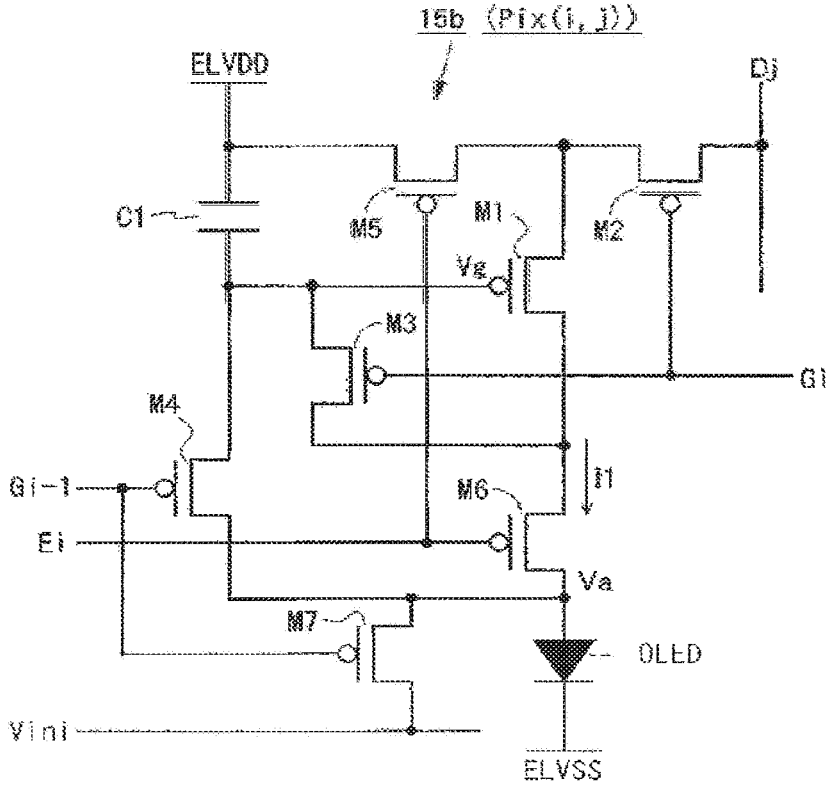
FIG. 4 is a circuit diagram illustrating a configuration of a pixel circuit in another known display device (second known example).

4. Configuration, Operation and Problems of Pixel Circuit in Second Known Example In the pixel circuit 15*a* in the first known example, the gate terminal of the drive transistor M1 is connected to the initialization voltage supply line Vini via only the first initialization transistor M4. However, as illustrated in FIG. 4, a pixel circuit 15*b* having a configuration where the gate terminal of the drive transistor M1 is connected to the anode electrode of the organic EL element OLED via the first initialization transistor M4 and connected to the initialization voltage supply line Vini via the first initialization transistor M4 and the second initialization transistor M7 is also known (see, for example, see PTL 1). A display device using the pixel circuit 15*b* configured as illustrated in FIG. 4 will be referred to as a "second known example", and the pixel circuit 15*b* in the second known example will be described. Note that the overall configuration of the second known example is the same as the configuration illustrated in FIG. 1 except for the initialization connecting line ILj (j=1 to m−1).

Similar to the pixel circuit 15*a* (FIG. 2) in the first known example, as illustrated in FIG. 4, the pixel circuit 15*b* according to the second known example includes the organic EL element OLED as a display element, the drive transistor M1, the write control transistor M2, the threshold compensation transistor M3, the first initialization transistor M4, the first light emission control transistor M5, the second light emission control transistor M6, the second initialization transistor M7, and the holding capacitor C1. The transistors M2 to M7 other than the drive transistor M1 function as switching elements. In the pixel circuit 15*b*, the gate terminal of the drive transistor M1 is connected to the anode electrode of the organic EL element OLED via the first initialization transistor M4, and in this regard, the pixel circuit 15*b* differs from the pixel circuit 15*a* in the first known example. Similar to the pixel circuit 15*a* in the first known example, the anode electrode of the organic EL element OLED is connected to the initialization voltage supply line Vini via the second initialization transistor M7, but the preceding scanning signal line Gi−1 is connected to the gate terminal of the second initialization transistor M7. Thus, in the ith row, jth column pixel circuit 15*b*, i.e., the pixel circuit Pix(i, j) in the second known example, both the first and second initialization transistors M4 and M7 are in an on state in the select period of the preceding scanning signal line Gi−1 (i−1th scanning select period). Thus, in the i−1th scanning select period, the first and second initialization transistors connected in series to each other form a path for initializing the voltage of the gate terminal of the drive transistor M1 (holding voltage of the holding capacitor C1). Other configurations in the pixel circuit 15*b* in the second known example are the same as the pixel circuit 15*a* in the first known example.

Drive of the scanning signal lines Gi, Gi−1, the light emission control line Ei, and the data signal line Dj used for operating the pixel circuit 15*b* (Pix(i, j)) in the second known example is similar to that of the first known example (see FIG. 3).

With the pixel circuit 15*b* in the second known example, the voltage applied between the source and drain of the first initialization transistor M4 in the light emission period is reduced and leakage current is suppressed further than in the pixel circuit 15*a* in the first known example. As a result, a drop in the gate voltage Vg due to leakage current of the transistor in the off state in the light emission period is suppressed, which suppresses the occurrence of a bright dot defect.

However, the inventors of the present application studied the operation of the pixel circuit 15*b* (FIG. 4) in the second known example and discovered the following problems.

When the gate voltage Vg of the drive transistor M1 is to be initialized, the charge stored in the holding capacitor C1 may flow not only to the initialization voltage supply line Vini via the first initialization transistor M4 and the second initialization transistor M7 but also to the low-level power source line ELVSS via the first initialization transistor M4 and the organic EL element OLED. As a result, slight excess lighting may occur in the organic EL element OLED. When the pixel circuit 15*b* is to create a black display, the gate voltage Vg in the light emission period is high, so the current flowing through the organic EL element OLED to the low-level power source line ELVSS increases during a subsequent reset period, which increases the amount of the excess light. In this way, in the pixel circuit 15*b* (FIG. 4) in the second known example, the luminance of the black display pixels increases due to some of the discharged current of the holding capacitor C1 flowing through the organic EL element OLED to the low-level power source line ELVSS in the reset period. As a result, contrast of the displayed image decreases.

5. Configuration and Operation of Pixel Circuit in Present Embodiment

Figure 5:
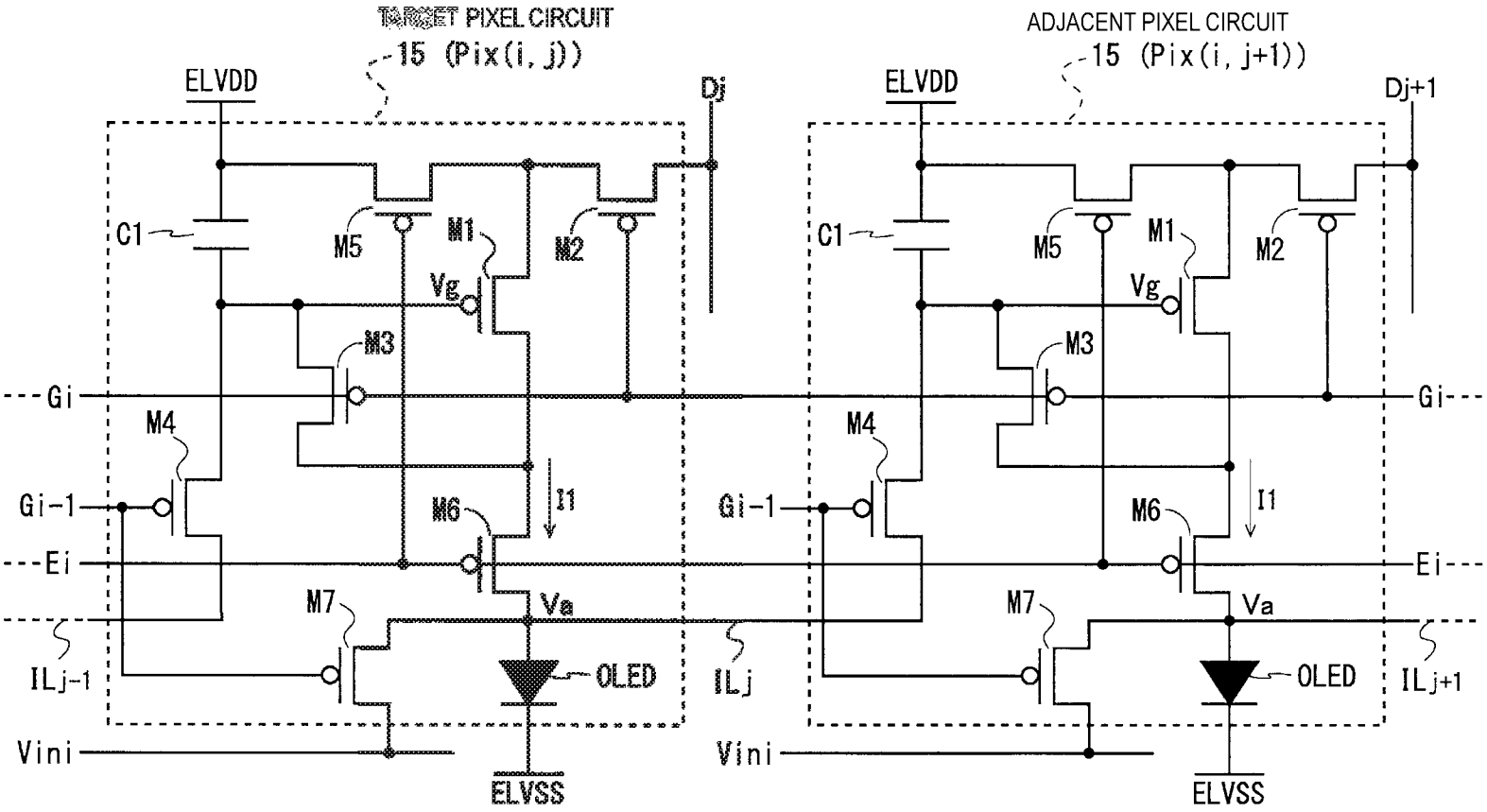
FIG. 5 is a circuit diagram illustrating a configuration of a pixel circuit according to the first embodiment.
Figure 6:
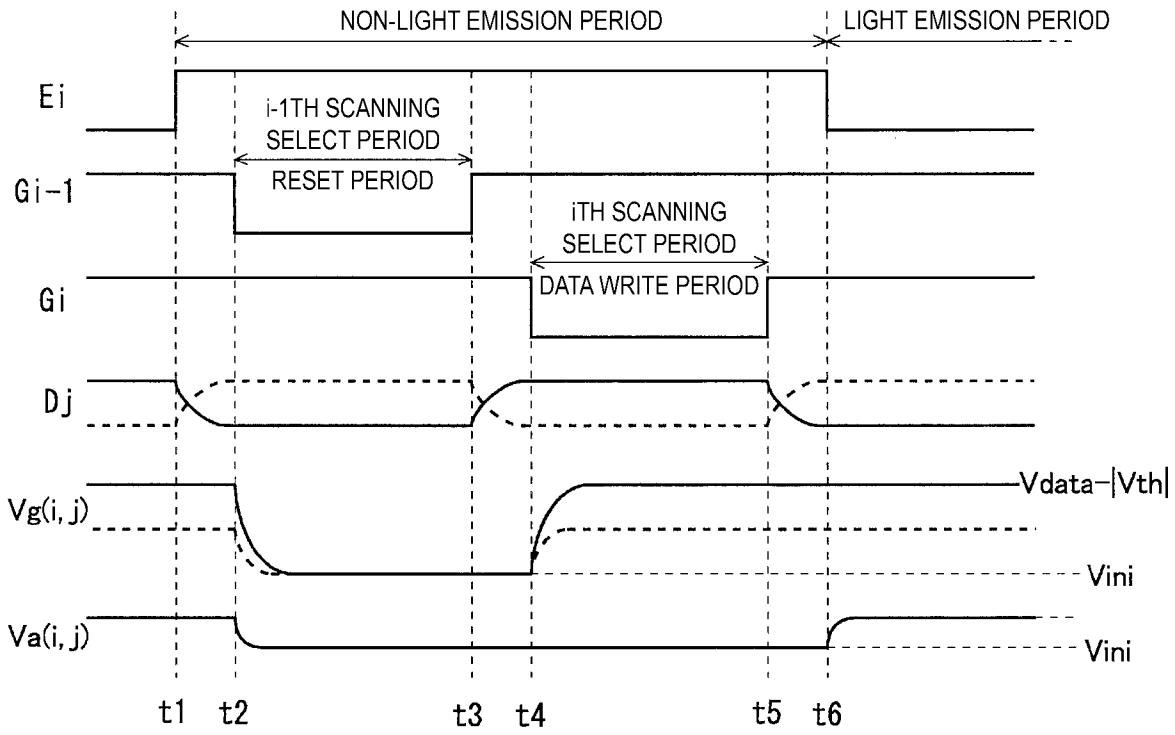
FIG. 6 is a signal waveform diagram for explaining drive of the display device according to the first embodiment.
Figure 7:
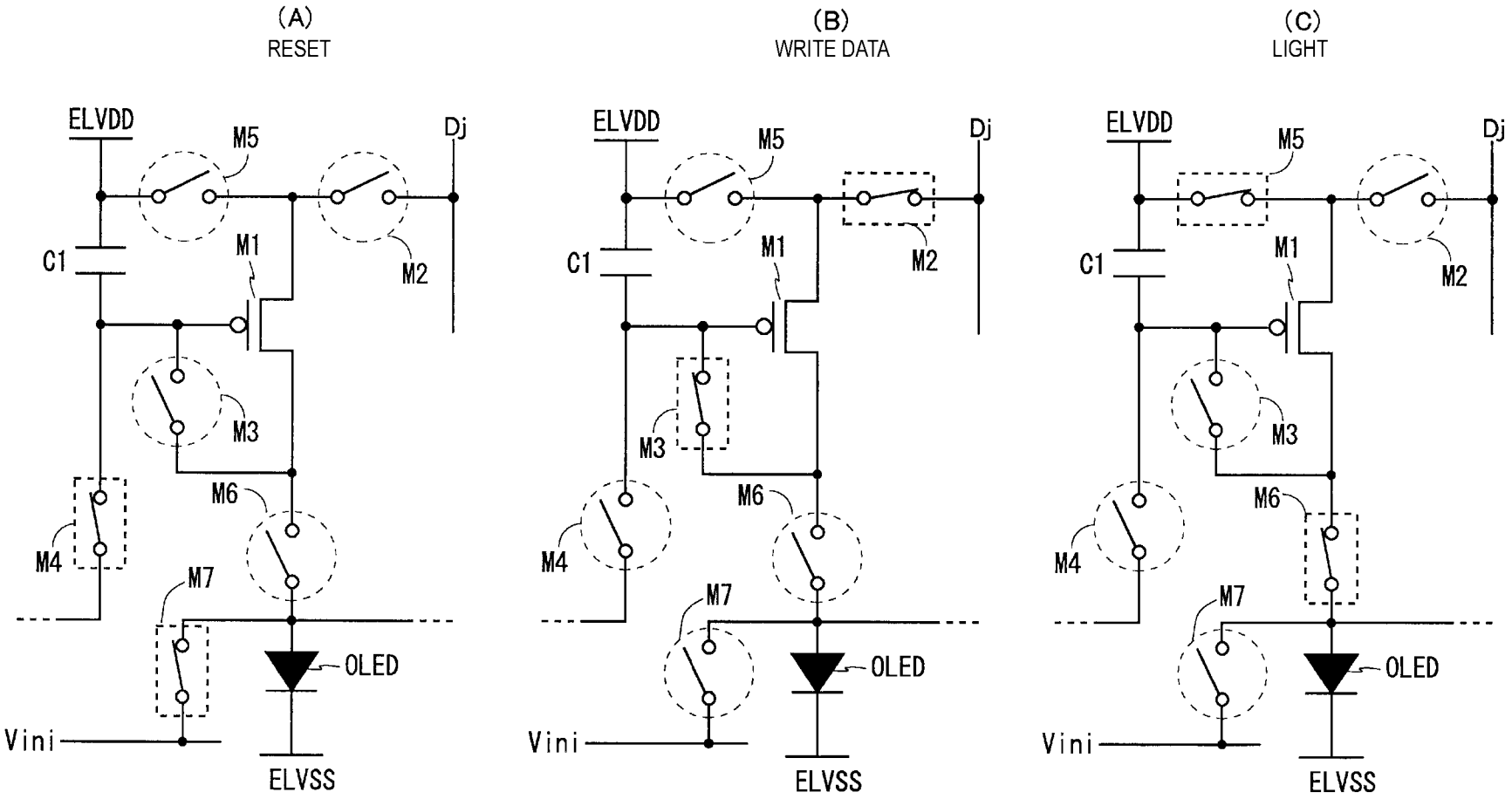
FIGS. 7(A) to 7(C) are circuit diagrams, where

Next, the configuration and operation of the pixel circuit 15 in the present embodiment will be described with reference to FIGS. 5 to 7. FIG. 5 is a circuit diagram illustrating a configuration of the pixel circuit 15 in the present embodiment. FIG. 6 is a signal waveform diagram for explaining drive of the organic EL display device 10 according to the present embodiment. FIG. 7(A) is a circuit diagram illustrating a reset operation of the pixel circuit 15 in the present embodiment, FIG. 7(B) is a circuit diagram illustrating a data write operation of the pixel circuit 15, and FIG. 7(C) is a circuit diagram illustrating a lighting operation of the pixel circuit 15.

FIG. 5 illustrates the configuration of a pixel circuit 15 corresponding to the ith scanning signal line Gi and the jth data signal line Dj in the present embodiment, i.e., the configuration of an ith row, jth column pixel circuit Pix(i, j) ($1 \leq i \leq n$, $1 \leq j \leq m$), and the configuration of a pixel circuit 15 corresponding to the ith scanning signal line Gi and a j+1th data signal line Dj+1, i.e., the configuration of an ith row, j+1th column pixel circuit Pix(i, j+1) ($1 \leq i \leq n$, $1 \leq j \leq m-1$). The two pixel circuits Pix(i, j) and Pix (i, j+1) correspond to the ith scanning signal line Gi and are adjacent to each other in the extension direction of the scanning signal lines G1 to Gn (hereinafter referred to as "scanning signal line extension direction"). In the following, of these two pixel circuits Pix(i, j) and Pix(i, j+1), the ith row, jth column pixel circuit Pix(i, j) is referred to as a "target pixel circuit Pix(i, j)" or a "target pixel circuit 15", and the ith row, j+1th column pixel circuit Pix(i, j) is referred to as an "adjacent pixel circuit Pix(i, j+1)" or an "adjacent pixel circuit 15".

Similar to the pixel circuit 15*a* (FIG. 2) in the first and second known examples described above, the target pixel circuit 15 and the adjacent pixel circuit 15 each include the organic EL element OLED as a display element, the drive transistor M1, the write control transistor M2, the threshold compensation transistor M3, the first initialization transistor M4, the first light emission control transistor M5, the second light emission control transistor M6, the second initialization transistor M7, and the holding capacitor C1. As above, in both the target pixel circuit 15 and the adjacent pixel circuit 15, the transistors M2 to M7 other than the drive transistor M1 function as switching elements.

As illustrated in FIG. 1, in both the target pixel circuit 15 (Pix(i, j)) and the adjacent pixel circuit 15 (Pix(i, j+1)), a scanning signal line (corresponding scanning signal line) Gi corresponding to the target pixel circuit 15 and the adjacent pixel circuit 15, a scanning signal line (preceding scanning signal line) Gi−1 immediately before the corresponding scanning signal line Gi, a light emission control line (corresponding light emission control line) Ei corresponding to the preceding scanning signal line Gi−1, an initialization voltage supply line Vini, a high-level power source line ELVDD, and a low-level power source line ELVSS are connected to each other. The data signal line (corresponding data signal line) Dj corresponding to the target pixel circuit Pix(i, j) is connected to the target pixel circuit Pix(i, j), and the data signal line (corresponding data signal line) Dj+1 corresponding to the adjacent pixel circuit Pix(i, j+1) is connected to the adjacent pixel circuit Pix(i, j+1).

As illustrated in FIG. 5, in the target pixel circuit 15, similar to the pixel circuit 15*a* (FIG. 2) in the first and second known examples, a source terminal of the drive transistor M1 serving as a first conduction terminal is connected to the corresponding data signal line Dj via the write control transistor M2 and to the high-level power source line ELVDD via the first light emission control transistor M5. A drain terminal serving as a second conduction terminal of the drive transistor M1 is connected to an anode electrode serving as a first terminal of the organic EL element OLED via the second light emission control transistor M6. The gate terminal of the drive transistor M1 is connected to the high-level power source line ELVDD via the holding capacitor C1, and the drain terminal of the drive transistor M1 via the threshold compensation transistor M3. The gate terminal is also connected to a source terminal of the first initialization transistor M4 serving as a first conduction terminal (the connection destination of the drain terminal of the first initialization transistor M4 serving as a second conduction terminal is described later). The anode electrode of the organic EL element OLED is connected to the initialization voltage supply line Vini via the second initialization transistor M7, and a cathode electrode of the organic EL element OLED is connected to the low-level power source line ELVSS. Gate terminals of the write control transistor M2 and the threshold compensation transistor M3 are connected to the corresponding scanning signal line Gi. Gate terminals of the first and second light emission control transistors M5 and M6 are connected to the corresponding light emission control line Ei. Gate terminals of the first and second initialization transistors M4 and M7 are connected to the preceding scanning signal line Gi−1.

Figure 9:
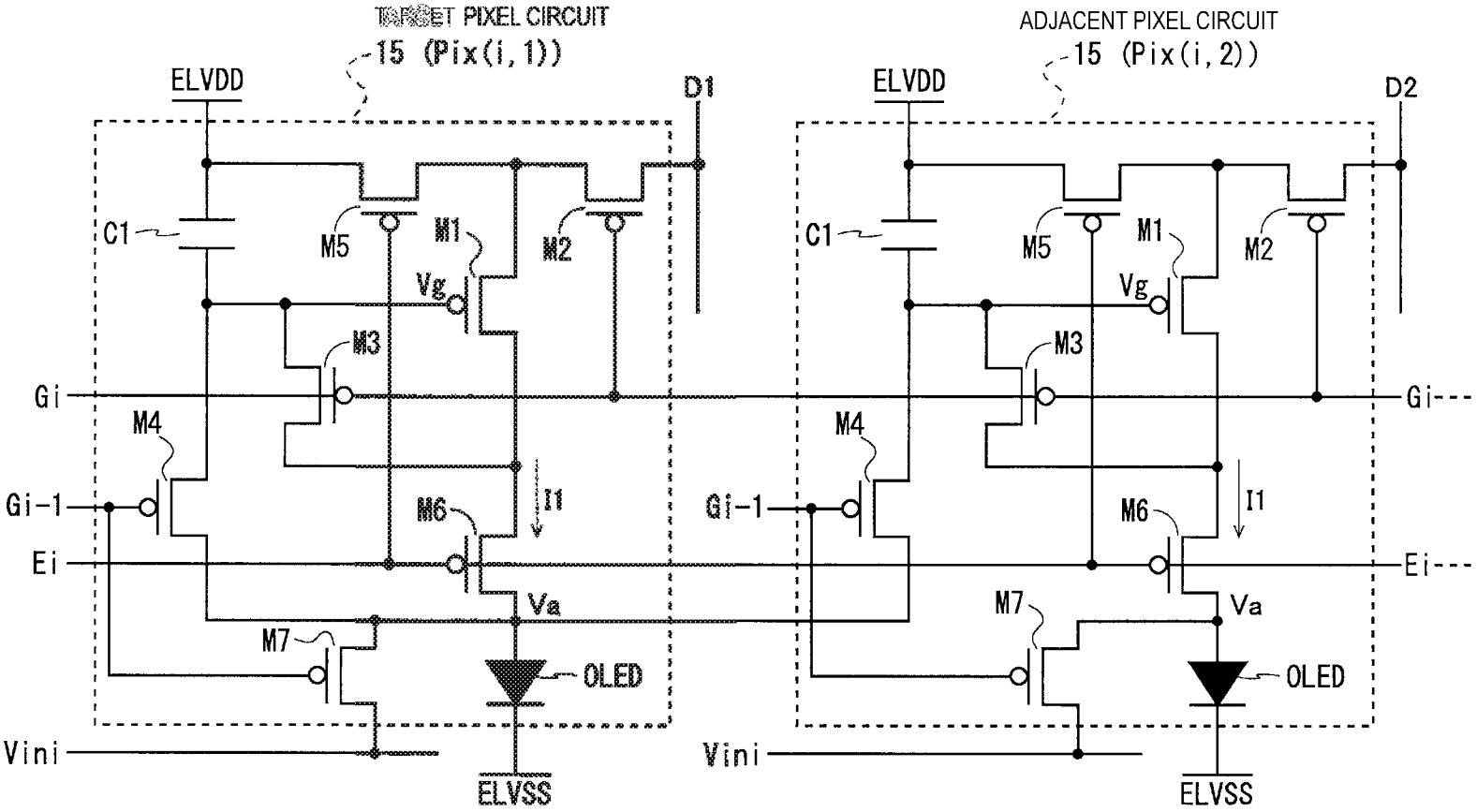
FIG. 9 is a circuit diagram illustrating a configuration example of a pixel circuit at end portions according to the first embodiment.

As illustrated in FIG. 5, the configuration of the adjacent pixel circuit 15 is the same as the configuration of the above-described target pixel circuit 15. However, the data signal line corresponding to the target pixel circuit 15 is the jth column data signal line Dj, and a data signal line corresponding to another pixel circuit 15 is a j+1th data signal line Dj+1. Thus, in the target pixel circuit 15, the source terminal of the drive transistor M1 is connected to the jth data signal line Dj as the corresponding data signal line via the write control transistor M2, whereas in the adjacent pixel circuit 15, the source terminal of the drive transistor M1 is connected to the j+1th data signal line Dj+1 as the corresponding data signal line via the write control transistor M2. As above, in the adjacent pixel circuit 15, the source terminal of the first initialization transistor M4 is connected to the gate terminal of the drive transistor M1. The drain terminal of the first initialization transistor M4 is connected to the anode electrode of the organic EL element OLED in the target pixel circuit 15. Thus, as illustrated in FIG. 5, the gate terminal of the drive transistor M1 in the adjacent pixel circuit 15 is connected to the initialization voltage supply line Vini via the first initialization transistor M4 in the adjacent pixel circuit 15, the initialization connecting line ILj, and the second initialization transistor M7 in the target pixel circuit 15. In other words, the gate terminal of the drive transistor M1 (one terminal of the holding capacitor C1) in the ith row, j+1th column pixel circuit Pix(i, j+1) is connected to the anode electrode of the organic EL element OLED in the ith row, jth column pixel circuit Pix(i, j) via the first initialization transistor M4 inside the pixel circuit Pix(i, j+1), and the anode electrode is connected to the initialization voltage supply line Vini via the second initialization transistor M7 (i=1 to n, j=1 to m−1). Note that, as illustrated in FIG. 9 described below, the drain terminal of the first initialization transistor M4 connected to the gate terminal of the drive transistor M1 in an ith row, 1st column pixel circuit Pix(i, 1) is connected to the anode electrode of the organic EL element OLED in the pixel circuit Pix(i, 1). However, the connection destination of the drain terminal of the first initialization transistor M4 in the pixel circuit Pix(i, 1) is not limited thereto (details described later).

Note that the configuration of the target pixel circuit 15 and the adjacent pixel circuit 15 illustrated in FIG. 5 is similar to two other pixel circuit 15 corresponding to any one of the n scanning signal lines G1 to Gn and adjacent to each other in the scanning signal line extension direction.

FIG. 6 illustrates fluctuation in the voltages of signal lines (corresponding light emission control line Ei, preceding scanning signal line Gi−1, corresponding scanning signal line Gi, and corresponding data signal line Dj) in the initialization operation, the reset operation, and the lighting operation of the pixel circuit 15 illustrated in FIG. 5, i.e., the ith row, jth column pixel circuit Pix(i, j), the gate voltage Vg of the drive transistor M1, and the anode voltage Va of the organic EL element OLED. In FIG. 6, similar to the first and second known examples described above (see FIG. 3), the period from the time t1 to the time t6 is a non-light emission period of the ith row pixel circuits Pix(i, 1) to Pix(i, m). The period from the time t2 to the time t4 is the i−1th horizontal period, and the period from the time t2 to the time t3 is the select period of the i−1th scanning signal line (preceding scanning signal line) Gi−1, i.e., the i−1th scanning select period. The i−1th scanning select period corresponds to a reset period of the ith row pixel circuits Pix(i, 1) to Pix (i, m). The period from the time t4 to the time t6 is the ith horizontal period, and the period from the time t4 to the time t5 is the select period of the ith scanning signal line (corresponding scanning signal line) Gi, i.e., the ith scanning select period. The ith scanning select period corresponds to the data write period of the ith row pixel circuits Pix(i, 1) to Pix(i, m). Hereinafter, operation of the ith row, jth column pixel circuit 15 (Pix(i, j)) where j≥2 will be described (reference is also made to the operation of the adjacent pixel circuit 15 (Pix(i, j+1)) as necessary). Operation of the pixel circuit 15 (Pix(i, 1)) in a case where j=1 will be described later.

Also in the present embodiment, in the ith row, jth column pixel circuit Pix(i, j), when the voltage of the light emission control line Ei changes from the low level to the high level at the time t1 as illustrated in FIG. 6, the first and second light emission control transistors M5 and M6 change from the on state to the off state, and the organic EL element OLED enters a non-light emission state, similar to the first and second known examples described above. During the period from the time t1 to the start time t2 of the i−1th scanning select period, the data-side drive circuit 30 starts to apply the data signal D(j) to the data signal line Dj as the data voltage of an i−1th row, jth column pixel. In the pixel circuit Pix(i, j), the write control transistor M2 connected to the data signal line Dj is in an off state.

At the time t2, the voltage of the preceding scanning signal line Gi−1 changes from the high level to the low level, which causes the preceding scanning signal line Gi−1 to enter a select state. Therefore, the first and second initialization transistors M4 and M7 enter an on state.

The period from the time t2 to the time t3 is a reset period in the ith row pixel circuits Pix(i, 1) to Pix(i, m). In the reset period, in the pixel circuit Pix(i, j), the first and second initialization transistors M4 and M7 are in the on state as described above. FIG. 7(A) schematically illustrates the state of the pixel circuit Pix(i, j) in the reset period, i.e., the circuit state during the reset operation. In FIG. 7(A), the dotted circles indicate that the transistors serving as switching elements in the pixel circuit are in an off state and the dotted rectangles indicate that the transistors serving as switching elements in the pixel circuit are in an on state (such a representation is also employed in FIGS. 7(B) and 7(C)). In the reset period, as illustrated in FIG. 7(A), the first and second initialization transistors M4 and M7 are in the on state. The preceding scanning signal line Gi−1 connected to the gate terminals of the first and second initialization transistors M4 and M7 is connected to the gate terminals of the first and second initialization transistors M4 and M7 in all the ith row target pixel circuits Pix(i, 1) to Pix(i, m) (see FIG. 1). Thus, all the first and second initialization transistors M4 and M7 are in the on state. Thus, during the reset period, the gate terminal of the drive transistor M1 in the pixel circuit Pix(i, j) is electrically connected to the initialization voltage supply line via the second initialization transistor M7 in a j−1th pixel circuit (not illustrated and hereinafter also referred to as an "preceding adjacent pixel circuit") Pix(i, j−1) connected at an initialization connecting line ILj−1. In other words, the second initialization transistor M7 in the preceding adjacent pixel circuit Pix(i, j−1), the initialization connecting line ILj−1, and the first initialization transistor M4 in the target pixel circuit Pix(i, j) form a path (hereinafter referred to as a "reset path") for applying the initialization voltage Vini to the gate terminal of the drive transistor M1. Thus, during the reset period, the reset path causes the initialization voltage Vini to be supplied from the initialization voltage line Vini to the gate terminal of the drive transistor M1. As a result, the gate voltage Vg and the holding voltage of the holding capacitor C1 are initialized in the same manner as in the first and second known examples described above (see Expressions (3) and (4) above). During the reset period, the second initialization transistor M7 is in the on state, and thus the charge held in the parasitic capacitance of the organic EL element OLED is discharged. As a result, the anode voltage Va is also initialized.

In the reset period (t2 to t3), an adjacent pixel circuit (hereinafter also referred to as "subsequent pixel circuit" when distinguishing from the preceding adjacent pixel circuit) Pix(i, j+1) operates in the same way as the target pixel circuit Pix(i, j), and the second initialization transistor M7 in the target pixel circuit Pix (i, j), the initialization connecting line ILj and the first initialization transistor M4 in the adjacent pixel circuit Pix(i, j+1) form a reset path for applying the initialization voltage Vini to the gate terminal of the drive transistor M1 in the adjacent pixel circuit Pix(i, j+1) (see FIG. 5). Thus, during the reset period, the initialization voltage Vini is also supplied from the initialization voltage supply line Vini to the gate terminal of the drive transistor M1 in the adjacent pixel circuit Pix(i, j+1) due to the reset path (see FIG. 8 to be described later).

At the time t3, as illustrated in FIG. 6, the voltage of the preceding scanning signal line Gi−1 changes to the high level, which causes the preceding scanning signal line Gi−1 to enter a non-select state. Thus, in the pixel circuit Pix(i, j), the first and second initialization transistors M4 and M7 change to the off state. During the period from the time t3 to the start time t4 of the ith scanning select period, the data-side drive circuit 30 starts to apply the data signal D(j) to the data signal line Dj as the data voltage of the ith row, jth column pixel, and continues to apply the data signal D(j) until at least the end time t5 of the ith scanning select period. During this period, a data signal D(j+1) starts to be applied to the data signal line Dj+1 as the data voltage of the ith row, j+1th column pixel, and the data signal D(j+1) continues to be applied until at least the end time t5 of the ith scanning select period.

At the time t4, as illustrated in FIG. 6, the voltage of the corresponding scanning signal line Gi changes from the high level to the low level, which causes the corresponding scanning signal line Gi to enter a select state. Because of this, the write control transistor M2 and the threshold compensation transistor M3 change to the on state in the pixel circuit Pix(i, j).

The period from the time t4 to the time t5 is a data write period in the ith pixel circuits Pix(i, 1) to Pix(i, m). In the data write period, the write control transistor M2 and the threshold compensation transistor M3 are in an on state as described above. FIG. 7(B) schematically illustrates the state of the pixel circuit Pix(i, j) in the data write period, i.e., the circuit state during the data write operation. In this data write period, similar to the first and second known examples described above, the voltage of the corresponding data signal line Dj is applied to the holding capacitor C1 as the data voltage Vdata via the drive transistor M1 in the diode-connected state. As a result, as illustrated in FIG. 6, the gate voltage Vg(i, j) changes toward the value given in Expression (5) above. That is, in the data write period, a data voltage that has undergone threshold compensation is written to the holding capacitor C1, and the gate voltage Vg(i, j) is the value given by Expression (5) above.

At the time t5, which is the end time of the ith scanning select period as the data write period, the voltage of the corresponding scanning signal line Gi changes to the high level. As a result, the write control transistor M2 and the threshold compensation transistor M3 change to the off state in the pixel circuit Pix(i, j).

Then, at the time t6, the voltage of the light emission control line Ei changes to a low level. Thus, the first and second light emission control transistors M5 and M6 change to the on state in the pixel circuit Pix(i, j). The time after the time t6 is a light emission period. In this light emission period, in the pixel circuit Pix(i, j), the first and second light emission control transistors M5 and M6 are in an on state as described above, and the write control transistor M2, the threshold compensation transistor M3, the first initialization transistor M4, and the second initialization transistor M7 are in the off state. FIG. 7(C) schematically illustrates the state of the pixel circuit Pix(i, j) in the light emission period, i.e., the circuit state during the lighting operation. In the light emission period, similar to the first and second known examples described above, the current I1 flows from the high-level power source line ELVDD to the low-level power source line ELVSS via the first light emission control transistor M5, the drive transistor M1, the second light emission control transistor M6, and the organic EL element OLED. The current I1 corresponds to the voltage written to the holding capacitor C1 during the data write period (t4 to t5), and threshold compensation is performed simultaneously in the data write period to derive the current I1 by Expression (6). As a result, in the light emission period, similar to the first and second known examples described above, the organic EL element OLED emits light at a luminance corresponding to the data voltage Vdata, which is the voltage of the corresponding data signal line Dj in the ith scanning select period, regardless of the threshold voltage Vth of the drive transistor M1.

6. Actions and Effects

In the present embodiment as described above, similar to the first and second known examples, in the pixel circuit Pix(i, j), the voltage of the corresponding data signal line Dj is applied to the holding capacitor C1 as the data voltage Vdata via the drive transistor M1 in the diode-connected state, thereby compensating for variations and fluctuations in the threshold voltage of the drive transistor M1. In order to write data along with this threshold compensation, the gate voltage Vg of the drive transistor M1 needs to be initialized (initialization of the holding voltage of the holding capacitor C1) prior to the data write operation, similar to the first and second known examples. In the present embodiment, the reset path for this initialization differs from the first and second known examples. This point will be described below with reference to FIG. 8.

Figure 8:
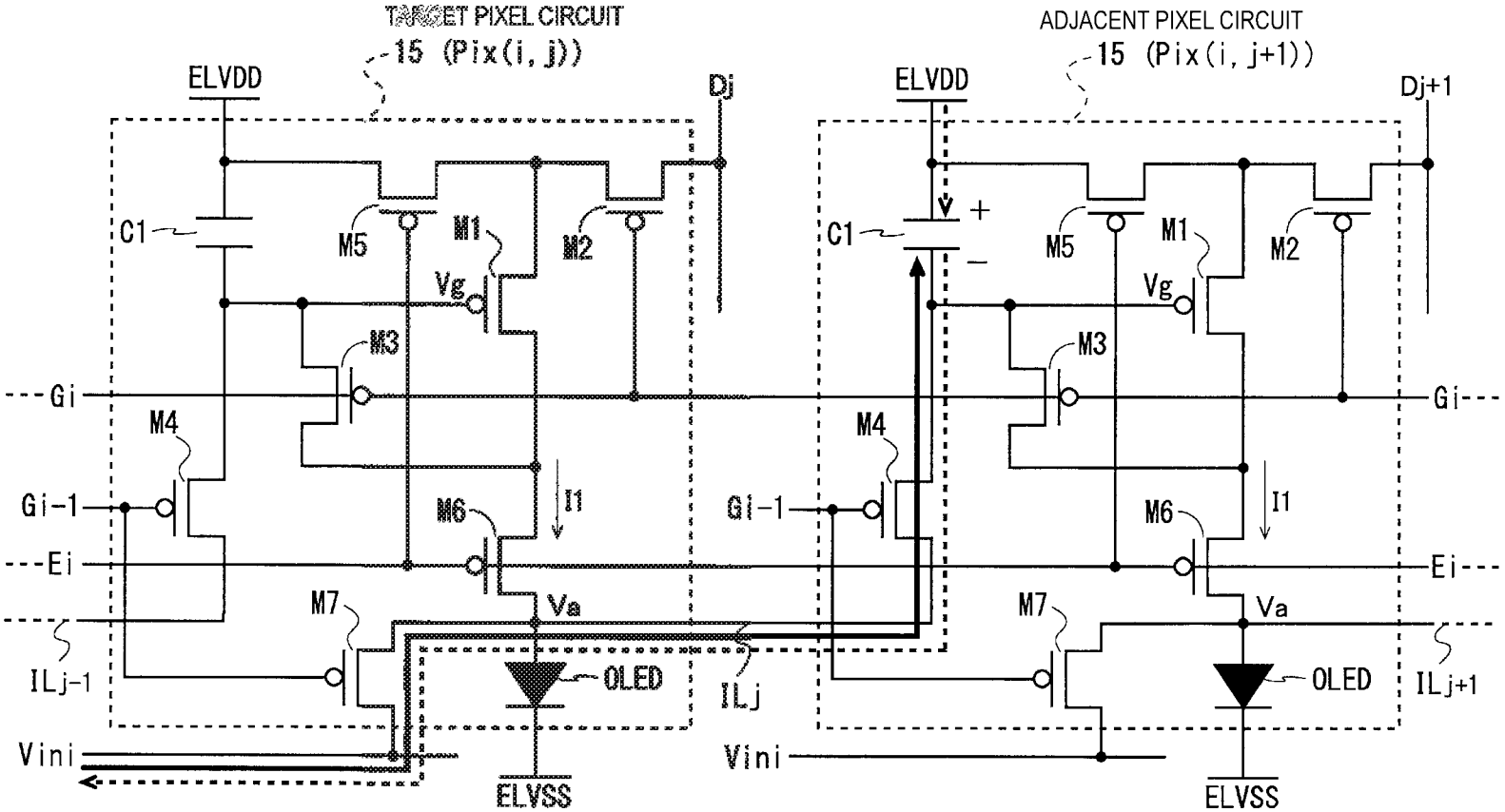
FIG. 8 is a circuit diagram for explaining the actions and effects of the first embodiment.

FIG. 8 is a circuit diagram for explaining the actions and effects of the present embodiment, and illustrates a configuration of a target pixel circuit Pix(i, j) and a (subsequent) adjacent pixel circuit Pix(i, j+1). Here, for convenience of illustration, the initialization of the gate voltage Vg of the drive transistor M1 will be described focusing on the adjacent pixel circuit Pix(i, j+1).

The present embodiment differs from the first known example (FIG. 2) and is the same as the second known example (FIG. 4) in that the first and second initialization transistors M4 and M7 are included in a reset path formed for initialization of the gate voltage Vg of the drive transistor M1. However, as illustrated in FIG. 8, the present embodiment differs from the second known example in that the reset path is formed by the second initialization transistor M7 in the target pixel circuit Pix(i, j), the initialization connecting line ILj, and the first initialization transistor M4 in the adjacent pixel circuit Pix(i, j+1) (see the thick solid line in FIG. 8). Note that in the present embodiment, because the drive transistor M1 is a P-channel transistor, forming the reset path causes current to flow as indicated by the dotted line in FIG. 8 to charge the holding capacitor C1. As a result, the gate voltage Vg is initialized to the initialization voltage Vini.

In such an embodiment, as illustrated in FIG. 8, the drain terminal of the first initialization transistor M4 connected to the gate terminal of the drive transistor M1 is not directly connected to the initialization voltage supply line Vini and instead connected to the anode electrode of the organic EL element OLED (of a pixel circuit adjacent in the scanning signal line extension direction), and the anode electrode is connected to the initialization voltage supply line Vini via the second initialization transistor M7. The anode voltage Va of the organic EL element OLED is higher than the voltage of the initialization voltage supply line Vini in the light emission period by at least several volts. Because of this, the voltage applied between the source and drain of the first initialization transistor M4 in the off state in the light emission period is a voltage corresponding to the difference between the gate voltage Vg of the drive transistor M1 and the anode voltage Va, and is smaller than the voltage (Vg−Vini) applied between the source and drain of the first initialization transistor M4 (see FIG. 2) in the off state in the first known example. As a result, leakage current from a transistor in the off state that leads to a drop in the gate voltage Vg during the light emission period is sufficiently reduced. Thus, unlike the first known example, it is possible to suppress a drop in the gate voltage Vg due to leakage current from a transistor in the off state in the light emission period without increasing the size of the first initialization transistor M4. Thus, with the present embodiment, it is possible to provide a pixel circuit 15 having the function of threshold compensation with no bright dot defects due to leakage current as described above without increasing the area of the pixel circuit 15.

Note that in the pixel circuit 15, the threshold compensation transistor M3 is connected to the gate terminal of the drive transistor M1 in addition to the first initialization transistor M4, and hence leakage current of the threshold compensation transistor M3 is also considered as leakage current that may lead to a drop in the gate voltage Vg during the light emission period. However, as described above, in the light emission period, the anode voltage Va of the organic EL element OLED is higher than the voltage of the initialization voltage supply line Vini by at least several volts, and the second light emission control transistor M6 is in the on state. Because of this, the voltage applied between the source and drain of the threshold compensation transistor M3 in the off state in the light emission period is also a relatively small voltage corresponding to the difference between the gate voltage Vg of the drive transistor M1 and the anode voltage Va, and a drop in the gate voltage Vg due to leakage current of the threshold compensation transistor M3 is not a problem.

In the present embodiment, unlike the second known example (FIG. 4), the gate terminal of the drive transistor M1 is connected to the anode electrode of the organic EL element OLED in the adjacent pixel circuit in the scanning signal line extension direction via the first initialization transistor M4 and the initialization connecting line ILj. Thus, a reduction in contrast of the displayed image caused by discharged current of the holding capacitor C1 in the reset period can be suppressed further than in the second known example. Now, this point will be described with reference to FIG. 8.

In the pixel circuit 15 (FIG. 5, FIG. 8) in the present embodiment and the pixel circuit 15*b* (FIG. 4) in the second known example, when the gate voltage Vg of the drive transistor M1 is to be initialized as described above, the charge accumulated in the holding capacitor C1 not only flows to the initialization voltage supply line Vini via the first initialization transistor M4 and the second initialization transistor M7 but also flows to the low-level power source line ELVSS via the first initialization transistor M4 and the organic EL element OLED. As a result, slight excess lighting may occur in the organic EL element OLED.

When the organic EL element OLED is to be driven based on the same degree of data voltage in the target pixel circuit Pix (i, j) and the adjacent pixel circuit Pix(i, j+1) in the present embodiment, the light emission amount of lighting caused by the discharge of the holding capacitor C1 in the reset period (hereinafter referred to as "light emission amount due to reset discharge") is the same as that in the second known example. Thus, in this case, excessive lighting occurs in the reset period to the same degree as in the second known example.

However, when the organic EL element OLED is to be driven based on a data voltage for a dark display with the target pixel circuit Pix(i, j) (hereinafter referred to as "dark display drive") or when the organic EL element OLED is to be driven based on a data voltage for a light display with the adjacent pixel circuit Pix(i, j+1) (hereinafter referred to as "light display drive"), the gate voltage Vg of the drive transistor M1 in the adjacent pixel circuit Pix(i, j+1) is low, and hence the light emission amount due to reset discharge is low in the target pixel circuit Pix(i, j) performing dark display drive. In other words, the amount of light emission of excess light is reduced compared to the second known example. On the other hand, when light display drive is performed by the target pixel circuit Pix(i, j) and dark display drive is performed by the adjacent pixel circuit Pix(i, j+1), the gate voltage Vg of the drive transistor M1 in the adjacent pixel circuit Pix(i, j+1) is high, and hence the light emission amount due to reset discharge is large in the target pixel circuit Pix(i, j) performing light display drive. In this case, the amount of light emission of excess light increases compared to the second known example, but because the target pixel circuit Pix(i, j) is driven with a light display, increase in the amount of light emission is not a problem. Thus, when the pixel circuit 15 performing light display drive and the pixel circuit 15 performing dark display drive are adjacent to each other in the scanning signal line extension direction, the amount of light emission of the extra light in the pixel circuit 15 performing light display drive is reduced during the reset period, and the amount of light emission of excess light in the pixel circuit 15 performing dark display drive is increased. As a result, the contrast between adjacent pixels formed by these pixel circuits 15, 15 can be improved.

As described above, with the present embodiment, when displaying an image in which pixels having the same degree of brightness are aligned in the scanning signal line extension direction (horizontal direction), excessive lighting occurs in the reset period as in the second known example. When displaying image in which light pixels and dark pixels are arranged adjacent to each other in the scanning signal line extension direction (horizontal direction), contrast of the displayed image can be improved further than in the second known example.

Note that, as evident from FIG. 5, the configuration of the pixel circuit 15 in the present embodiment only differs from the known pixel circuits 15*a* and 15*b* (FIGS. 2 and 4) in that the connection destination of the drain terminal of the first initialization transistor M4 is changed to the anode terminal of the organic EL element OLED in the preceding adjacent pixel circuit. Accordingly, it is easy to change the layout pattern corresponding to the configuration of the known pixel circuit 15*a* to a layout pattern corresponding to the configuration of the pixel circuit 15 of the present embodiment.

7. Other

In the above description, the ith row, jth column pixel circuit Pix(i, j) is used as the target pixel circuit 15 with j≥2, but no preceding adjacent pixel circuit is present (1≤i≤n) if a j=1 pixel circuit (hereinafter referred to as a "first column pixel circuit") Pix(i, 1) is the target pixel circuit 15. Thus, the target pixel circuit 15 (Pix(i, 1)) differs from the target pixel circuit 15 illustrated in FIG. 5 and is configured as illustrated in FIG. 9. That is, in the first column pixel circuit Pix(i, 1), the drain terminal of the first initialization transistor M4 is connected to the anode electrode of the organic EL element OLED in the pixel circuit Pix(i, 1). Thus, for the pixel circuit Pix(i, 1) where j=1, the actions and effects on the amount of light emission caused by the reset discharge are different from the other pixel circuits Pix(i, j), but other actions and effects are similar to the other pixel circuits Pix(i, j) (1≤i≤n, 2≤j≤m).

Figure 10:
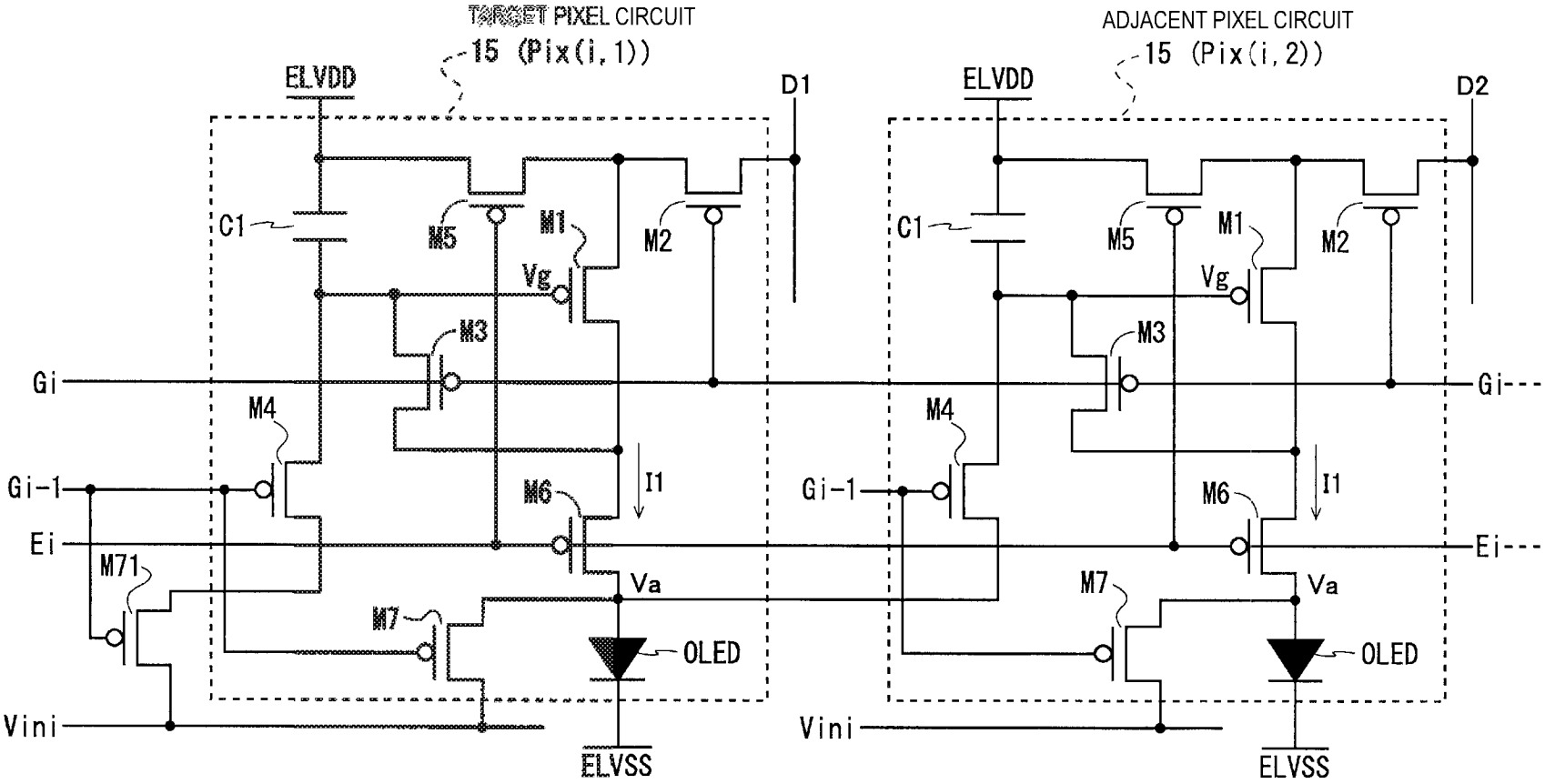
FIG. 10 is a circuit diagram illustrating another configuration example of a pixel circuit at end portions according to the first embodiment.

The configuration illustrated in FIG. 10 can be used in place of the configuration illustrated in FIG. 9 for the first column pixel circuit Pix(i, 1). In the configuration illustrated in FIG. 10, the internal configuration of the first column pixel circuit Pix(i, 1) is the same as the other pixel circuits Pix(i, j) (1≤i≤n, 2≤j≤m), and an initialization transistor (hereinafter referred to as "end initialization transistor") M71 is provided for each first column pixel circuit Pix(i, 1). As illustrated in FIG. 10, the drain terminal of the first initialization transistor M4 in the first column pixel circuit Pix(i, 1) is connected to the initialization voltage supply line Vini via the end initialization transistor M71 nearby the drain terminal, and a gate terminal of the end initialization transistor M71 is connected to the preceding scanning signal line Gi−1. When adopting the configuration illustrated in FIG. 10 as described above, similar actions and effects as those of other pixel circuits Pix(i, j) (1≤i≤n, 2≤j≤m) are obtained for the first column pixel circuits Pix(i, 1).

Figure 11:
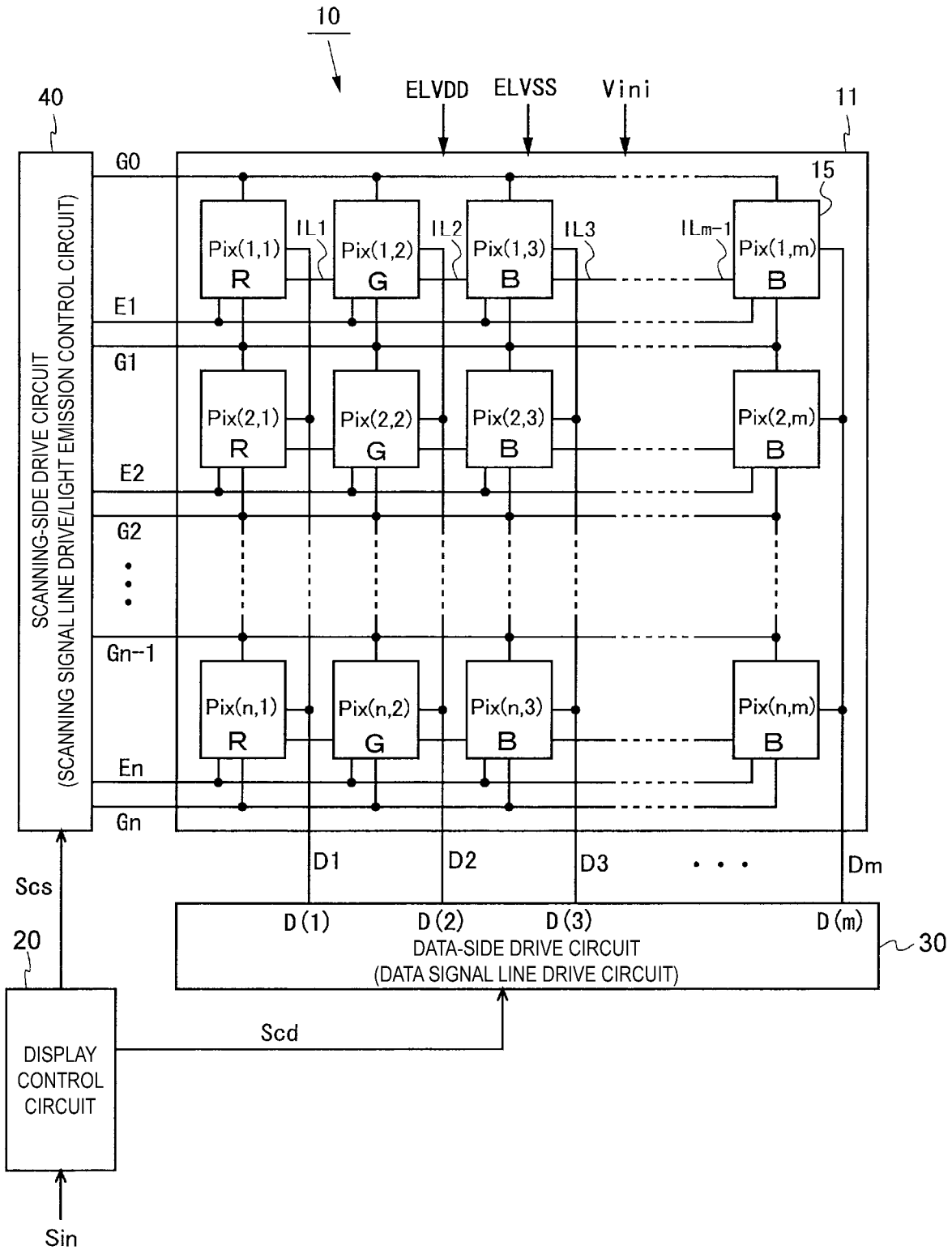
FIG. 11 is a block diagram illustrating an overall configuration of a color image display device as a configuration example of the display device according to a first embodiment.

In order to create a color image display in the present embodiment, as illustrated in FIG. 11 for example, one pixel of the color image is formed by three pixel circuits adjacent to each other in the scanning signal line extension direction (pixel circuits corresponding to the three primary colors). FIG. 11 is a block diagram illustrating an overall configuration of a color image display device as an example of a display device according to the present embodiment. In FIG. 11, "R", "G", and "B", which are assigned to the lower portion in the rectangle indicating the pixel circuit 15, indicate that the luminescent colors (of the organic EL element OLED) as display colors of the pixel circuit are red, green, and blue, respectively. In such a display device, the drain terminal of the first initialization transistor M4 in each pixel circuit 15 is connected to the anode electrode of an organic EL element OLED in the preceding adjacent pixel circuit 15 having a different luminescent color to the pixel circuit. However, even in a configuration where the gate terminal of the drive transistor M1 is connected to the organic EL element OLED in another pixel circuit 15 having a different luminescent color via the first initialization transistor M4, the same effects as those described above can be obtained. Note that various other patterns can be used as the arrangement pattern of the plurality of pixel circuits 15 used for forming one pixel in the color image. Depending on the arrangement pattern, one conceivable configuration is a configuration where the drain terminal of the first initialization transistor M4 in the target pixel circuit 15 is connected to the anode electrode of the organic EL element OLED in another adjacent pixel circuit 15 having the same luminescent color. Even with such a configuration, the same effects as those described above can be obtained. In particular, a green sub-picture element in which the light emission color is formed by green pixel circuits has high luminous sensitivity, and there is no need for an arrangement pattern in which the number of green pixel circuits as green sub-pixels is greater than the number of red pixel circuits and the number of blue pixel circuits. Therefore, applying the configuration of the present embodiment between green pixel circuits in such an arrangement pattern is effective.

8. Modification Example

The disclosure is not limited to the embodiment described above, and various modifications may be made without departing from the scope of the disclosure. For example, in the embodiment described above, the drain terminal of the first initialization transistor M4 of the target pixel circuit Pix(i, j) is connected to the anode electrode of the organic EL element OLED of the preceding adjacent pixel circuit Pix(i, j−1) via the initialization connecting line ILj−1 (see FIG. 5). Alternatively, the drain terminal of the first initialization transistor M4 may be connected to the anode electrode of the organic EL element OLED of the subsequent adjacent pixel circuit Pix(i, j+1) via the initialization connecting line ILj.

In the above description, an organic EL display device has been described as an example and an embodiment and a modification example thereof have been given. However, the disclosure is not limited to an organic EL display device and may be applied to any display device employing an internal compensation method using a display element driven by a current. The display element that can be used in such a configuration is a display element in which luminance, transmittance, or other factors are controlled by a current and includes, for example, an organic EL element, i.e., an organic light-emitting diode (OLED), or an inorganic light-emitting diode or a quantum dot light-emitting diode (QLED).

REFERENCE SIGNS LIST

10 Organic EL display device
11 Display portion
15 Pixel circuit
Pix(i, j) Pixel circuit (i=1 to n, j=1 to m)
20 Display control circuit
30 Data-side drive circuit (data signal line drive circuit)
40 Scanning-side drive circuit (scanning signal line drive/light emission control circuit)
Gi Scanning signal line (i=1 to n)
Ei Light emission control line (i=1 to n)
Dj Data signal line (j=1 to m)
Vini Initialization voltage supply line, initialization voltage
ILj Initialization connecting line (j=1 to m−1)
ELVDD High-level power source line (first power source line), high-level power supply voltage
ELVSS Low-level power source line (second power source line), low-level power supply voltage
OLED Organic EL element
C1 Holding capacitor
M1 Drive transistor
M2 Write control transistor (write control switching element)
M3 Threshold compensation transistor (threshold compensation switching element)
M4 First initialization transistor (first initialization switching element)
M5 First light emission control transistor (first light emission control switching element)
M6 Second light emission control transistor (second light emission control switching element)
M7 Second initialization transistor (second initialization switching element)

The invention claimed is:

1. A display device including a plurality of data signal lines, a plurality of scanning signal lines intersecting the plurality of data signal lines, and a plurality of pixel circuits arranged in a matrix along the plurality of data signal lines and the plurality of scanning signal lines, the display device comprising:

an initialization voltage supply line;

a data signal line drive circuit configured to drive the plurality of data signal lines; and a scanning signal line drive circuit configured to selectively drive the plurality of scanning signal lines, each pixel circuit comprising:

a display element driven by a current;

a holding capacitor configured to hold a voltage used for controlling a drive current of the display element;

a drive transistor configured to control a drive current of the display element according to a voltage held by the holding capacitor; and first and second initialization switching elements, wherein, in each pixel circuit, a first terminal of the display element is connected to the initialization voltage supply line via the second initialization switching element, in any two pixel circuits of the plurality of pixel circuits corresponding to any one of the plurality of scanning signal lines and being adjacent to each other in an extension direction of the plurality of scanning signal lines, a control terminal of the drive transistor in a first pixel circuit of the two pixel circuits is connected to the first terminal of the display element in a second pixel circuit of the two pixel circuits via the first initialization switching element in the first pixel circuit, and when the two pixel circuits are to be initialized, the first and second initialization switching elements in the two pixel circuits are controlled to an on state.

2. The display device according to claim 1, wherein, in each pixel circuit, the control terminal of the drive transistor is connected to one terminal of the holding capacitor.

3. The display device according to claim 2, wherein the first and second pixel circuits are connected to one corresponding scanning signal line.

4. The display device according to claim 3, further comprising:

first and second power source lines;

a plurality of light emission control lines individually corresponding to the plurality of scanning signal lines; and a light emission control circuit configured to drive the plurality of light emission control lines, wherein each pixel circuit further comprises:

a write control switching element;

a threshold compensation switching element; and first and second light emission control switching elements, in each pixel circuit, a first conduction terminal of the drive transistor is connected to any one of the plurality of data signal lines via the write control switching element, and the first power source line via the first light emission control switching element, a second conduction terminal of the drive transistor is connected to the first terminal of the display element via the second light emission control switching element, the control terminal of the drive transistor is connected to the first power source line via the holding capacitor, and the second conduction terminal via the threshold compensation switching element, a second terminal of the display element is connected to the second power source line, control terminals of the write control switching element and the threshold compensation switching element are connected to any one of the plurality of scanning signal lines, and control terminals of the first and second light emission control switching elements are connected to one of the plurality of light emission control lines corresponding to any one of the plurality of scanning signal lines, and control terminals of the first and second initialization switching elements are connected to one of the plurality of scanning signal lines selected immediately before selecting any one of the plurality of scanning signal lines.

5. The display device according to claim 4, wherein, in each pixel circuit, the control terminals of the first and second initialization switching elements are connected to one of the plurality of scanning signal lines selected immediately before selecting any one of the plurality of scanning signal lines, in the scanning signal line drive circuit, a plurality of scanning signals are applied to each of the plurality of scanning signal lines such that the plurality of scanning signal lines are sequentially selected in predetermined periods, the plurality of scanning signals being sequentially activated in each predetermined period, and in the light emission control circuit, for each of the plurality of scanning signal lines, a light emission control signal is applied to one of the plurality of light emission control lines corresponding to each scanning signal line, the light emission control signal being a signal where a non-light emission period including a select period of the scanning signal line and a select period of the preceding scanning signal line, which is a scanning signal line selected immediately before selecting the scanning signal line, is inactive, and a light emission period including a select period of a scanning signal line other than the scanning signal line and the preceding scanning signal line is active.

6. The display device according to claim 4, wherein the first power source line is a high voltage-side power source line, and the second power source line is a low voltage-side power source line, and the drive transistor is a P-channel transistor.

7. The display device according to claim 1, wherein a display color of the display element in the first pixel circuit and a display color of the display element in the second pixel circuit are different.

8. The display device according to claim 1, wherein a display color of the display element in the first pixel circuit and a display color of the display element in the second pixel circuit are the same.

9. The display device according to claim 8, wherein a display color of the display element in the first pixel circuit and a display color of the display element in the second pixel circuit are green.

10. A method for driving a display device including a plurality of data signal lines, a plurality of scanning signal lines intersecting the plurality of data signal lines, an initialization voltage supply line, and a plurality of pixel circuits arranged in a matrix along the plurality of data signal lines and the plurality of scanning signal lines, the method for driving a display device comprising:

an initialization step of initializing each pixel circuit, wherein each pixel circuit comprises:

a display element driven by a current;

a holding capacitor configured to hold a voltage used for controlling a drive current of the display element;

a drive transistor configured to control a drive current of the display element according to a voltage held by the holding capacitor; and first and second initialization switching elements, in each pixel circuit, a first terminal of the display element is connected to the initialization voltage supply line via the second initialization switching element, in any two pixel circuits of the plurality of pixel circuits corresponding to any one of the plurality of scanning signal lines and being adjacent to each other in an extension direction of the plurality of scanning signal lines, a control terminal of the drive transistor in a first pixel circuit of the two pixel circuits is connected to the first terminal of the display element in a second pixel circuit of the two pixel circuits via the first initialization switching element in the first pixel circuit, and in the initialization step, when the first and second pixel circuits are to be initialized, the first and second initialization switching elements are controlled to an on state.

11. The method for driving a display device according to claim 10, wherein the display device further comprises first and second power source lines, each pixel circuit further comprises:

a write control switching element;

a threshold compensation switching element; and first and second light emission control switching elements, in each pixel circuit, a first conduction terminal of the drive transistor is connected to any one of the plurality of data signal lines via the write control switching element, and the first power source line via the first light emission control switching element, a second conduction terminal of the drive transistor is connected to the first terminal of the display element via the second light emission control switching element, a control terminal of the drive transistor is connected to the first power source line via the holding capacitor, and the second conduction terminal via the threshold compensation switching element, and a second terminal of the display element is connected to the second power source line.

12. The method for driving a display device according to claim 11, further comprising:

a data writing step in which, in each pixel circuit, when writing a voltage of any one of the plurality of data signal lines to the holding capacitor as a data voltage, the write control switching element and the threshold compensation switching element are controlled to an on state, and the first light emission control switching element, the second light emission control switching element, the first initialization switching element, and the second initialization switching element are controlled to an off state.

13. The method for driving a display device according to claim 12, further comprising:

a lighting step in which, in each pixel circuit, when the display element is to be driven based on a holding voltage of the holding capacitor, the first light emission control switching element and the second light emission control switching element are controlled to an on state, and the write control switching element, the threshold compensation switching element, the first initialization switching element, and the second initialization switching element are controlled to an off state.

* * * * *